US012398538B2

(12) United States Patent
Abe et al.

(10) Patent No.: US 12,398,538 B2
(45) Date of Patent: Aug. 26, 2025

(54) WORKING MACHINE INCLUDING A CONTROLLER CONFIGURED TO CONTROL AN ACTUATION VALVE BASED ON TRAVELING MOTOR REVOLUTIONS

(71) Applicant: KUBOTA CORPORATION, Osaka (JP)

(72) Inventors: Daiki Abe, Osaka (JP); Ryota Hamamoto, Osaka (JP); Jun Tomita, Osaka (JP); Fumiya Kozono, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 343 days.

(21) Appl. No.: 18/073,705

(22) Filed: Dec. 2, 2022

(65) Prior Publication Data

US 2023/0287654 A1 Sep. 14, 2023

(30) Foreign Application Priority Data

Mar. 8, 2022 (JP) ..... 2022-035622

(51) Int. Cl.
*E02F 3/00* (2006.01)
*E02F 9/22* (2006.01)

(52) U.S. Cl.
CPC ..... *E02F 9/2253* (2013.01); *E02F 9/2267* (2013.01); *E02F 9/2285* (2013.01); *E02F 9/2292* (2013.01); *E02F 9/2296* (2013.01)

(58) Field of Classification Search
CPC ..... E02F 9/2253; E02F 9/2267; E02F 9/2285; E02F 9/2292; E02F 9/2296; E02F 9/2228; E02F 3/3414; E02F 9/2289; E02F 9/22
USPC ..... 701/50
See application file for complete search history.

(56) References Cited

U.S. PATENT DOCUMENTS 4,726,186 A * 2/1988 Tatsumi ..... E02F 9/2285 60/434
10,618,527 B2 * 4/2020 Fukuda ..... B60W 50/085
2012/0310492 A1 * 12/2012 Karasawa ..... F16H 61/421 701/50

(Continued)

FOREIGN PATENT DOCUMENTS

JP 2013036274 2/2013
JP 2013036274 A * 2/2013

*Primary Examiner* — Tiffany P Young
*Assistant Examiner* — Leah N Miller
(74) *Attorney, Agent, or Firm* — Greenblum & Bernstein, P.L.C.

(57) ABSTRACT

A working machine includes a traveling pump to be operated by power of a prime mover and deliver a hydraulic fluid; a traveling motor that rotates using the delivered hydraulic fluid; an operation valve that changes pilot pressure of a pilot fluid outputted to the traveling pump in response to operation of an operation member; an actuation valve that operates based on a control signal and changes primary pressure that is the pilot pressure of the pilot fluid supplied to the operation valve; a controller that controls opening of the actuation valve by outputting the control signal to the actuation valve; and a first detector that detects an actual number of revolutions of the traveling motor. The controller includes a changer that changes setting of the control signal such that the opening of the actuation valve increases as the actual number of revolutions of the traveling motor decreases.

20 Claims, 15 Drawing Sheets

(56) References Cited

U.S. PATENT DOCUMENTS

| | | | | |
|---|---|---|---|---|
| 2013/0036729 | A1 | 2/2013 | Kinugawa et al. | |
| 2017/0284063 | A1* | 10/2017 | Fukuda | E02F 9/2235 |
| 2017/0350095 | A1* | 12/2017 | Fukuda | E02F 9/2025 |
| 2021/0180294 | A1* | 6/2021 | Shirouzu | F15B 21/087 |
| 2022/0049470 | A1* | 2/2022 | Abe | F16H 59/46 |

* cited by examiner

WORKING MACHINE INCLUDING A CONTROLLER CONFIGURED TO CONTROL AN ACTUATION VALVE BASED ON TRAVELING MOTOR REVOLUTIONS

CROSS REFERENCE TO RELATED APPLICATIONS

This application claims the benefit of priority to Japanese Patent Application No. 2022-035622 filed on Mar. 8, 2022. The entire contents of this application are hereby incorporated herein by reference.

BACKGROUND OF THE INVENTION

1. Field of the Invention

The present disclosure relates to a working machine such as a skid-steer loader, a compact track loader, or the like.

2. Description of the Related Art

A technique disclosed in Japanese Unexamined Patent Application Publication No. 2013-036274 has been known as art for preventing engine stall in a working machine such as a skid-steer loader, a compact track loader, or the like.

A working machine disclosed in Japanese Unexamined Patent Application Publication No. 2013-036274 includes an engine, an HST pump configured to operate by power of the engine, a traveling manipulator for manipulating the HST pump, a pressure control valve configured to control traveling primary pressure that is pressure on a primary side of the traveling manipulator, and a controller configured to control the pressure control valve. The traveling manipulator includes a traveling lever and a pilot valve. The pilot value outputs pilot pressure that is in proportion to an operation amount of the traveling lever.

The controller performs anti-stall control for preventing the engine from stalling. In the anti-stall control, the controller prevents the engine from stalling by controlling the pressure control valve based on a light-load characteristic curve, which is used when the engine is not under significant heavy load, and a drop characteristic curve, which is used when a predetermined load or heavier is applied to the engine. In other words, the controller makes a drop in the number of revolutions of the engine as small as possible by reducing the traveling primary pressure sharply by controlling the pressure control valve when a predetermined load or heavier is applied to the working machine, thereby achieving engine stall suppression.

SUMMARY OF THE INVENTION

In the technique disclosed in Japanese Unexamined Patent Application Publication No. 2013-036274, in a middle-revolution range of the engine (prime mover), an excessive engine drop is avoided by making the output of the pressure control valve low in order to ensure a sufficient hill-climbing speed, and appropriate engine revolution (middle-revolution range) is maintained to guarantee the vehicle speed.

However, when the engine is in a high-revolution range, there is a need to set the output of the pressure control valve high in order to prevent a phenomenon in which the engine revolution remains high (a phenomenon in which there is almost no engine drop because the output horsepower of the engine is in excess of the consumption horsepower of the HST pump (traveling pump)). If this phenomenon in which the engine revolution remains high occurs, it could give, to the operator, an operational feeling that the working machine is not performing work with sufficient performance (an operational feeling that the machine seems to be suppressing its horsepower output, contrary to operation by the operator).

To provide a solution to the above technical issue, there is a need to set the output of the pressure control valve low when the engine is in a middle-revolution range and to set the output of the pressure control valve high when the engine is in a high-revolution range. However, if the difference between the output of the pressure control valve when the engine is in a middle-revolution range and the output of the pressure control valve when the engine is in a high-revolution range is extremely large (if the slope of the output of the pressure control valve in relation to the number of revolutions of the engine is set to be steep), there is a risk that an engine revolution control instability such as hunting of the engine might arise.

Therefore, in order to give a priority to a hill-climbing speed, it is conceivable to perform output setting of the pressure control valve for a case where the engine is in a high-revolution range within a range of not triggering hunting after performing output setting of the pressure control valve for a case where the engine is in a middle-revolution range. Though this approach prevents the phenomenon in which the engine revolution remains high, it tends to result in a decrease in traveling power in a high-revolution range. Especially in work that involves opening a traveling relief valve, for example, when pushing dirt, the delivery flow rate of the HST pump (consumption horsepower of the HST pump) decreases due to the influence of the swash-plate characteristics of the HST pump, and the engine revolution to be balanced therewith will be high, resulting in giving an operational feeling that the working machine is not performing work with sufficient performance to the operator.

An object of the disclosed technique is to provide a working machine capable of giving an operational feeling that the working machine is performing work with sufficient performance to an operator.

A working machine according to an aspect of the present disclosure includes: a prime mover; a traveling pump to be operated by power of the prime mover and deliver a hydraulic fluid; a traveling motor to rotate using the hydraulic fluid delivered by the traveling pump; an operation valve to change pilot pressure of a pilot fluid outputted to the traveling pump in response to operation of an operation member; an actuation valve to operate based on a control signal and change primary pressure that is the pilot pressure of the pilot fluid supplied to the operation valve; a controller configured or programmed to control opening of the actuation valve by outputting the control signal to the actuation valve; and a first detector to detect an actual number of revolutions of the traveling motor, wherein the controller includes a changer configured or programmed to change setting of the control signal such that the opening of the actuation valve increases as the actual number of revolutions of the traveling motor decreases.

The working machine may further include a number-of-revolutions operation actuator, a second detector, and a storage unit. The number-of-revolutions operation actuator may be configured for an operator to operate a target number of revolutions of the prime mover. The second detector may be configured to detect an actual number of revolutions of the prime mover. A first line and a second line may be stored in the storage unit. The first line may be a line defining the control signal based on the actual number of revolutions of the prime mover in a case where a difference between the target number of revolutions of the prime mover and the actual number of revolutions of the prime mover is not less than a first threshold. The second line may be a line defining the control signal to be greater than defined by the first line in a case where the difference is less than the first threshold. The changer may be configured or programmed to change the first line by changing the control signal expressed by the first line such that the opening of the actuation valve increases as the actual number of revolutions of the traveling motor decreases.

Based on a first correction coefficient defined in relation to the actual number of revolutions of the traveling motor, the changer may be configured or programmed to change the control signal expressed by the first line.

At least one first function specifying a relation between the actual number of revolutions of the traveling motor and the first correction coefficient may be stored in the storage unit The changer may be configured or programmed to calculate the first correction coefficient by substituting the actual number of revolutions of the traveling motor detected by the first detector into the at least one first function.

The at least one first function may define the first correction coefficient in terms of value that is not less than one, such that the first correction coefficient corresponding to a second number of revolutions, which represents the actual number of revolutions of the traveling motor and is less than a first number of revolutions, is greater than the first correction coefficient corresponding to the first number of revolutions, which represents the actual number of revolutions of the traveling motor.

The at least one first function may have degrees of inclination which are different depending on whether the actual number of revolutions of the traveling motor is less than a second threshold thereof. The degree of inclination of the at least one first function in a range where the actual number of revolutions of the traveling motor is equal to or less than the second threshold, is greater than the degree of inclination of the at least one first function in a range where the actual number of revolutions of the traveling motor is not less than the second threshold.

The controller may be operable to be switched among a plurality of modes. As the at least one first function, a plurality of first functions different from one another in terms of inclination at least partially, to correspond to the plurality of modes, may be stored in the storage unit. The changer may be configured or programmed to calculate the first correction coefficient based on, among the plurality of first functions, a first function that corresponds to a mode of the controller.

Based on a second correction coefficient defined in relation to the actual number of revolutions of the prime mover in addition to the first correction coefficient, the changer may be configured or programmed to change the control signal expressed by the first line.

At least one second function specifying a relation between the actual number of revolutions of the prime mover and the second correction coefficient may be stored in the storage unit. The changer may be configured or programmed to calculate the second correction coefficient by substituting the actual number of revolutions of the prime mover detected by the second detector into the at least one second function.

The at least one second function may define the second correction coefficient as a value equal to one when the actual number of revolutions of the prime mover is not less than a third threshold, and define the second correction coefficient in terms of value that is less than one when the actual number of revolutions of the prime mover is less than the third threshold.

The controller may be operable to be switched among a plurality of modes. As the at least one second function, a plurality of second functions different from one another in terms of inclination at least partially, to correspond to the plurality of modes, may be stored in the storage unit. The changer may be configured or programmed to calculate the second correction coefficient based on, among the plurality of second functions, a second function that corresponds to a mode of the controller.

The changer may be configured or programmed to compute a third correction coefficient based on a product of the first correction coefficient and the second correction coefficient, change the control signal expressed by the first line in a case where a value of the third correction coefficient is greater than one, and not change the control signal expressed by the first line in a case where the value of the third correction coefficient is not greater than one.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
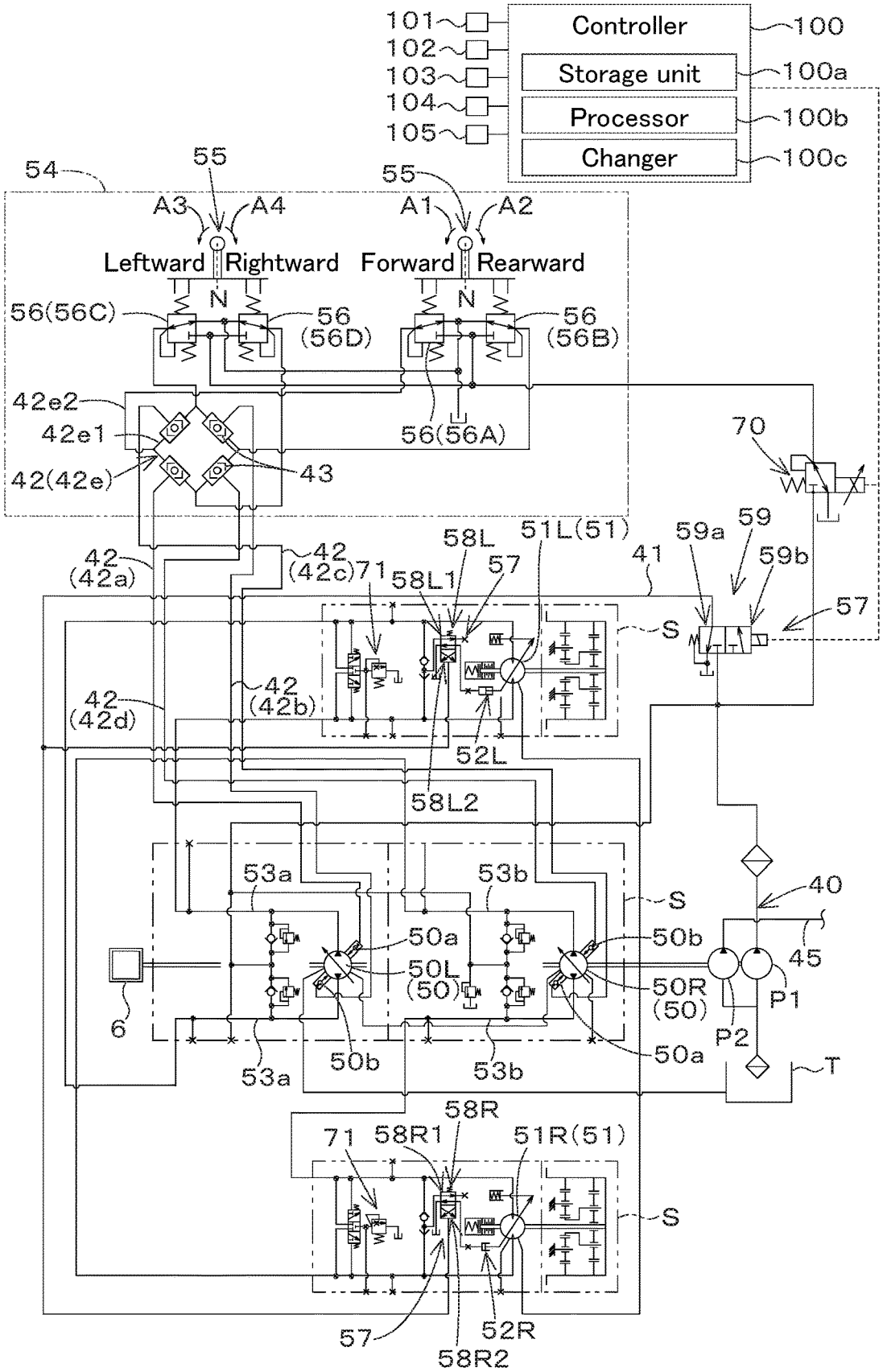
FIG. 1 is a diagram illustrating a hydraulic circuit for traveling in a hydraulic system (hydraulic circuit) of a working machine.

The preferred embodiments will now be described with reference to the accompanying drawings, wherein like reference numerals designate corresponding or identical elements throughout the various drawings. The drawings are to be viewed in an orientation in which the reference numerals are viewed correctly.

With reference to the accompanying drawings, an exemplary embodiment of the disclosed technique will now be explained.

Figure 10:
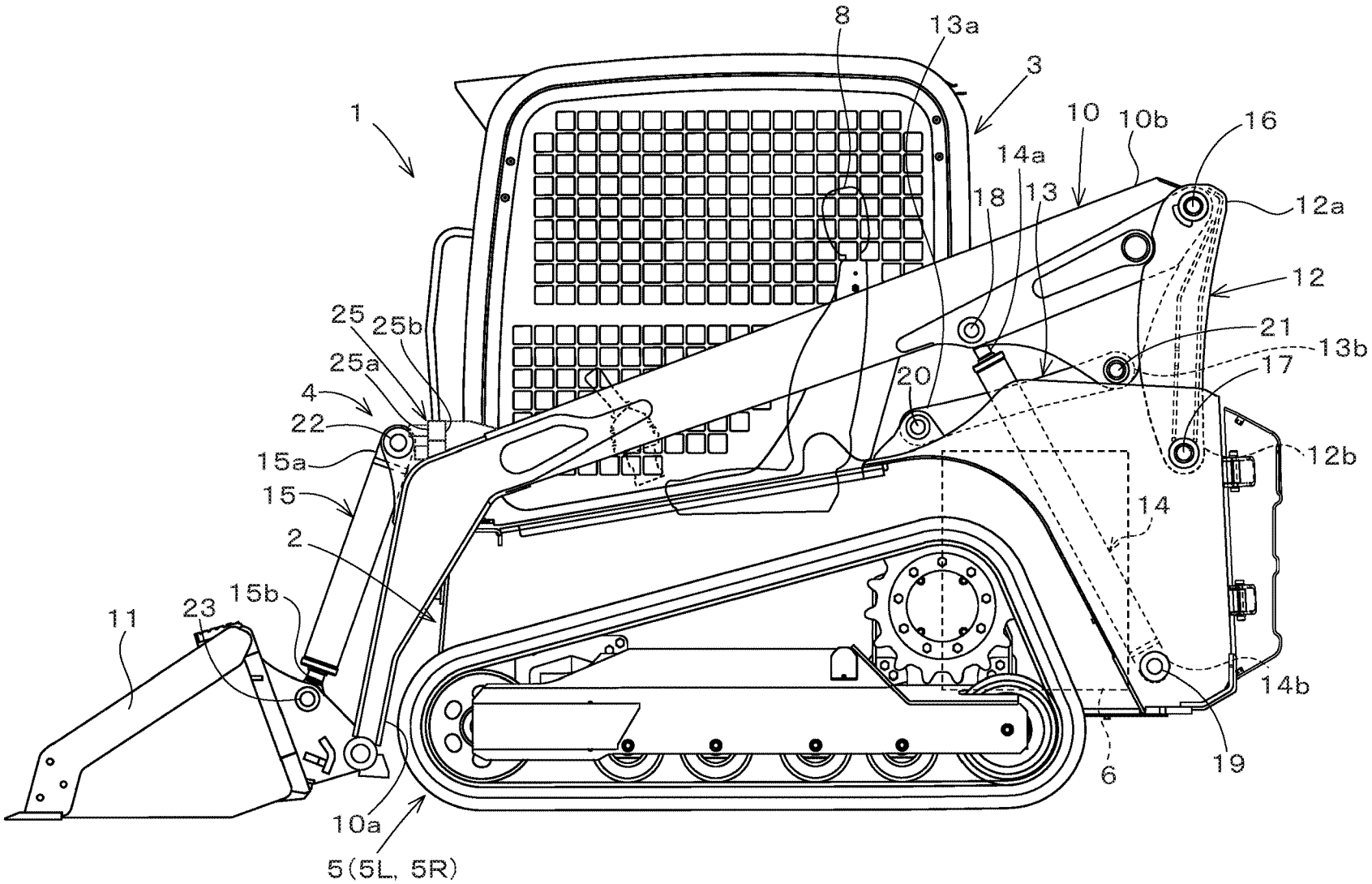
FIG. 10 is a side view of a track loader that is an example of the working machine.

FIG. 10 is a side view of a track loader that is an example of a working machine 1. In FIG. 10, a compact track loader is illustrated as an example of the working machine 1. However, the working machine 1 according to the present disclosure is not limited to a compact track loader but may be any other kind of loader machine such as, for example, a skid-steer loader. The working machine 1 may be any kind of working machine other than a loader machine.

As illustrated in FIG. 10, the working machine 1 includes a machine body 2, a cabin 3, a working device 4, and a traveling device 5. In an exemplary embodiment of the present disclosure, the term "forward" will be used for referring to a direction which an operator seated on an operator's seat 8 of the working machine 1 faces (leftward in FIG. 10), and the term "rearward" will be used for referring to the opposite direction thereof (rightward in FIG. 10). The term "leftward" will be used for referring to a direction going toward the left side as viewed from the operator (direction toward the near side in FIG. 10), and the term "rightward" will be used for referring to a direction going toward the right side as viewed from the operator (direction toward the far side in FIG. 10). A horizontal direction orthogonal to a front-rear direction will be referred to as "machine-body width direction".

The cabin 3 is mounted on the machine body 2. The operator's seat 8 is provided inside the cabin 3. The working device 4 is mounted on the machine body 2. A prime mover 6 is mounted on a rear portion inside the machine body 2. The traveling device 5 is provided outside the machine body 2. The traveling device 5 includes a first traveling device 5L provided on the left side of the machine body 2 and a second traveling device 5R provided on the right side of the machine body 2.

With reference to FIG. 10, the working device 4 will now be described in detail. The working device 4 includes booms 10, a working tool 11, lift links 12, control links 13, boom cylinders 14, and bucket cylinders 15.

The booms 10 are provided to the left and right of the cabin 3 respectively such that they can be moved pivotally up and down. The working tool 11 is, for example, a bucket. The working tool 11 is provided on a first end portion (front end portion) 10*a* of the booms 10 such that it can be moved pivotally up and down. The lift links 12 and the control links 13 support a second end portion (rear end portion) 10*b* of the booms 10, which is the opposite of the first end portion 10*a* thereof, to enable pivotal up-and-down motion of the booms 10. The boom cylinders 14 raise and lower the booms 10 by their extending-and-retracting motion. The bucket cylinders 15 move the working tool 11 pivotally by their extending-and-retracting motion.

The first end portion (front end portion) 10*a* of the left boom 10 and the first end portion (front end portion) 10*a* of the right boom 10 are coupled to each other via a non-standard-shaped coupling pipe (not illustrated). The second end portion (rear end portion) 10*b* of the left boom 10 and the second end portion (rear end portion) 10*b* of the right boom 10 are coupled to each other via a round coupling pipe.

The lift links 12, the control links 13, and the boom cylinders 14 are provided on the left and right sides with respect to the machine body 2 respectively for the left and right booms 10.

The lift link 12 is provided in vertical orientation behind the second end portion 10*b* of each of the booms 10. A first end portion (upper end portion) 12*a* of the lift links 12 is pivotally supported on a pivot shaft 16 near the rear end of the second end portion 10*b* of the booms 10 in such a way as to be able to rotate on its horizontal axis. A second end portion (lower end portion) 12*b* of the lift links 12, which is the opposite of the first end portion 12*a* thereof, is pivotally supported on a pivot shaft 17 near the rear end of the machine body 2 in such a way as to be able to rotate on its horizontal axis.

A first end portion (upper end portion) 14*a* of the boom cylinders 14 is pivotally supported on a pivot shaft 18 in such a way as to be able to rotate on its horizontal axis. The pivot shaft 18 is provided near a front portion of the second end portion 10*b* of the booms 10. A second end portion (lower end portion) 14*b* of the boom cylinders 14, which is the opposite of the first end portion 14*a* thereof, is pivotally supported on a pivot shaft 19 in such a way as to be able to rotate on its horizontal axis. The pivot shaft 19 is provided in the lower rear portion of the machine body 2.

The control links 13 are provided in front of the lift links 12. A first end portion (front end portion) 13*a* of the control links 13 is pivotally supported on a pivot shaft 20 in such a way as to be able to rotate on its horizontal axis. The pivot shaft 20 is provided on the machine body 2 in front of the lift links 12. A second end portion (rear end portion) 13*b* of the control links 13, which is the opposite of the first end portion 13*a* thereof, is pivotally supported on a pivot shaft 21 in such a way as to be able to rotate on its horizontal axis. The pivot shaft 21 is provided on the booms 10 ahead of, and above, the pivot shaft 17.

Therefore, the booms 10 move pivotally up and down around the pivot shaft 16 due to the extending-and-retracting motion of the boom cylinders 14, with their second end portion 10*b* supported by the lift links 12 and the control links 13. This pivotal motion raises and lowers the first end portion 10*a* of the booms 10. The control links 13 move pivotally up and down around the pivot shaft 20 when the booms 10 move pivotally up and down. The lift links 12 move pivotally forward and rearward around the pivot shaft 17 when the control links 13 move pivotally up and down.

In FIG. 10, a bucket is attached as an example of the working tool 11 to the first end portion 10*a* of the booms 10. However, an alternative working tool 11 can be attached to the first end portion 10*a* of the booms 10 in place of the bucket. The alternative working tool 11 attachable to the first end portion 10*a* of the booms 10 is an attachment (auxiliary attachment) such as, for example, a hydraulic crusher, a hydraulic breaker, an angle broom, an earth auger, a pallet fork, a sweeper, a mower, or a snow blower. The auxiliary attachment includes hydraulic devices such as a hydraulic motor and a hydraulic cylinder and operates using a hydraulic fluid supplied to it.

A connection member 25 is provided on the first end portion 10*a* of the left boom 10. The connection member 25 is a member for connection between a first conduit member (not illustrated) connected to the auxiliary attachment and a second conduit member (not illustrated) such as a pipe provided on the boom 10. Specifically, the first conduit member connected to the auxiliary attachment is connected to a first end portion (front end portion) 25*a* of the connection member 25. The second conduit member is connected to a second end portion (rear end portion) 25*b*, which is the opposite of the first end portion 25*a*. The connection enables a hydraulic fluid flowing through the second conduit member to be supplied to the auxiliary attachment through the first conduit member.

The bucket cylinders 15 are disposed near the first end portion 10*a* of the booms 10 respectively. A first end portion (upper end portion) 15*a* of the bucket cylinders 15 is pivotally supported on a pivot shaft 22 in such a way as to be able to rotate on its horizontal axis. The pivot shaft 22 is provided near the rear end of the first end portion 10*a* of the booms 10. A second end portion (lower end portion) 15*b* of the bucket cylinders 15, which is the opposite of the first end portion 15*a* thereof, is pivotally supported on a pivot shaft 23 in such a way as to be able to rotate on its horizontal axis. The pivot shaft 23 is provided on an upper rear portion of the working tool 11. Having this structure, the bucket cylinders 15 move the bucket 11 pivotally by their extending-and-retracting motion.

In the present embodiment, a crawler-type traveling system is adopted for each of the traveling device 5 on the left side (first traveling device 5L) and the traveling device 5 on the right side (second traveling device 5R). The traveling device 5 is not limited to a crawler-type traveling device such as one illustrated in FIG. 10. The traveling device 5 may be a semi-crawler-type traveling device or a wheeled-type traveling device having front and rear wheels.

The prime mover 6 is an internal combustion engine (engine) such as a diesel engine or a gasoline engine, or an electric motor, etc. In the present embodiment, the prime mover 6 is a diesel engine, but is not limited thereto.

With reference to FIG. 1, a hydraulic system for traveling will now be explained. FIG. 1 is a diagram illustrating a hydraulic circuit for traveling in a hydraulic system (hydraulic circuit) of the working machine 1. The hydraulic system for traveling of the working machine 1 is a system for causing the traveling device 5 to operate. As illustrated in FIG. 1, the working machine 1 includes a controller 100, a first hydraulic pump P1, a second hydraulic pump P2, a traveling pump 50, and a traveling motor 51. The controller 100 is a device configured in the form of an electric/electronic circuit, a program stored in a CPU or an MPU, or the like. The controller 100 controls various devices of the working machine 1. The controller 100 has a storage unit 100*a*. The storage unit 100*a* is a nonvolatile memory or the like. Various kinds of information regarding control by the controller 100 and the like are stored in the storage unit 100*a*.

The first hydraulic pump P1 operates by power of the prime mover 6 and delivers a hydraulic fluid. The first hydraulic pump P1 is a constant-displacement-type gear pump. Specifically, the first hydraulic pump P1 is connected between a hydraulic fluid tank T and a delivery fluid passage 40 and is capable of delivering a hydraulic fluid contained in the hydraulic fluid tank T to the delivery fluid passage 40. More particularly, the first hydraulic pump P1 delivers a hydraulic fluid to be used mainly for control of the working machine 1.

In the description below, of the hydraulic fluid delivered from the first hydraulic pump P1, the hydraulic fluid to be used for control may be referred to as "pilot fluid", and the pressure of the pilot fluid may be referred to as "pilot pressure".

The second hydraulic pump P2 operates by power of the prime mover 6 and delivers a hydraulic fluid. The second hydraulic pump P2 is a constant-displacement-type gear pump. The second hydraulic pump P2 is connected between the hydraulic fluid tank T and a main fluid passage 45 and is capable of delivering a hydraulic fluid contained in the hydraulic fluid tank T to the main fluid passage 45. More particularly, the second hydraulic pump P2 delivers a hydraulic fluid to a hydraulic system for work, which is not for traveling.

The traveling pump 50 and the traveling motor 51 are hydraulic-fluid-driven devices. In the description below, the traveling pump 50 and the traveling motor 51 may be referred to as hydraulic devices S. The traveling pump 50 is a pump configured to operate by power of the prime mover 6. In the present embodiment, the traveling pump 50 includes a first traveling pump SOL and a second traveling pump 50R. Specifically, the traveling pump 50 is a swash-plate variable displacement axial pump configured to operate by power of the prime mover 6. The traveling pump 50 includes a forward traveling pressure receiver 50*a* and a rearward traveling pressure receiver 50*b* on which pilot pressure acts. An angle of a swash plate of the traveling pump 50 changes according to the pilot pressure acting on the forward traveling pressure receiver 50*a* and the rearward traveling pressure receiver 50*b*.

The traveling pump 50 is capable of changing a delivery amount (output) of a hydraulic fluid supplied from the delivery fluid passage 40 and changing a delivery direction of the hydraulic fluid by the change in the angle of the swash plate.

The traveling motor 51 is a motor configured to operate using the hydraulic fluid delivered from the traveling pump 50 and transmit power to the drive shaft of the traveling device 5. In the present embodiment, the traveling motor 51 includes a first traveling motor 51L and a second traveling motor 51R.

The first traveling motor 51L is a motor configured to transmit power to the drive shaft of the traveling device 5 (first traveling device 5L) provided on the left side of the machine body 2. The first traveling motor 51L is capable of operating using the hydraulic fluid delivered from the first traveling pump SOL. Specifically, the first traveling motor 51L is connected to the first traveling pump SOL through a circulation fluid passage 53*a*. Therefore, the first traveling pump SOL is capable of delivering the hydraulic fluid to the first traveling motor 51L through the circulation fluid passage 53*a*.

The first traveling motor 51L is capable of changing its rotation speed (number of revolutions) based on the flow rate of the hydraulic fluid supplied from the first traveling pump SOL.

The first traveling motor 51L is capable of changing its rotation speed to a first speed (a predetermined low-speed range), which is LOW, and to a second speed (a predetermined high-speed range), which is HIGH. In the present embodiment, the rotation speed (number of revolutions) of the first traveling motor 51L can be changed by the extending-and-retracting motion of a swash plate switching cylinder 52L. Specifically, as illustrated in FIG. 1, the swash plate switching cylinder 52L is connected to the first traveling motor 51L. The rotation speed of the first traveling motor 51L is set to the first speed when the swash plate switching cylinder 52L is retracted. The rotation speed of the first traveling motor 51L is set to the second speed when the swash plate switching cylinder 52L is extended.

The second traveling motor 51R is a motor configured to transmit power to the drive shaft of the traveling device 5 (second traveling device 5R) provided on the right side of the machine body 2. The second traveling motor 51R is capable of operating using the hydraulic fluid delivered from the second traveling pump 50R. Specifically, the second traveling motor 51R is connected to the second traveling pump 50R through a circulation fluid passage 53*b*. Therefore, the second traveling pump 50R is capable of delivering the hydraulic fluid to the second traveling motor 51R through the circulation fluid passage 53*b*.

The second traveling motor 51R is capable of changing its rotation speed (number of revolutions) based on the flow rate of the hydraulic fluid supplied from the second traveling pump 50R.

The second traveling motor 51R is capable of changing its rotation speed to a first speed (a predetermined low-speed range), which is LOW, and to a second speed (a predetermined high-speed range), which is HIGH. In the present embodiment, the rotation speed (number of revolutions) of the second traveling motor 51R can be changed by the extending-and-retracting motion of a swash plate switching cylinder 52R. Specifically, as illustrated in FIG. 1, the swash plate switching cylinder 52R is connected to the second traveling motor 51R. The rotation speed of the second traveling motor 51R is set to the first speed when the swash plate switching cylinder 52R is retracted. The rotation speed of the second traveling motor 51R is set to the second speed when the swash plate switching cylinder 52R is extended.

As illustrated in FIG. 1, a traveling relief valve 71 is provided on the circulation fluid passage 53*a*, through which the first traveling motor 51L is connected to the first traveling pump SOL, and another traveling relief valve 71 is provided on the circulation fluid passage 53*b*, through which the second traveling motor 51R is connected to the second traveling pump 50R. The traveling relief valve 71 drains, to the hydraulic fluid tank T, the hydraulic fluid flowing through the circulation fluid passage 53*a*, 53*b* when the working machine 1 performs work such as pushing dirt by using its bucket.

Next, operation regarding the traveling of the working machine 1, that is, operation of the traveling device 5 (traveling operation), will now be explained in detail. As illustrated in FIG. 1, the working machine 1 includes a traveling manipulator (operation device) 54.

The manipulator 54 is a device for manipulating the traveling pump 50 (the first traveling pump 50L and the second traveling pump 50R). The manipulator 54 is capable of changing the angle of the swash plate (swash-plate angle) of the traveling pump 50 by changing the pilot pressure acting on the forward traveling pressure receiver 50*a* and the rearward traveling pressure receiver 50*b*. The manipulator 54 includes an operation member (a traveling lever) 55 and a plurality of operation valves (traveling operation valves) 56.

The operation member 55 is an operation lever configured to be swung in the left-right direction (machine-body width direction) or the front-rear direction selectively. The operation member 55 is supported on the operation valves 56. When the neutral position N of the operation member 55 is defined as its home position, the operation member 55 can be operated forward (in the direction indicated by an arrow A1 in FIG. 1) and rearward (in the direction indicated by an arrow A2 in FIG. 1) from the neutral position N, and leftward (in the direction indicated by an arrow A3 in FIG. 1) and rightward (in the direction indicated by an arrow A4 in FIG. 1) from the neutral position N.

In other words, the operation member 55 can be swung in at least four directions from the neutral position N defined as its home position. For the sake of explanation, in the description of the operation member 55 below, the two directions going forward and rearward, namely, the front-rear direction, may be hereinafter referred to as "first direction". The two directions going leftward and rightward, namely, the left-right direction (machine-body width direction), may be hereinafter referred to as "second direction".

Each of the plurality of operation valves 56 is a valve configured to be manipulated by operating the operation member 55. Specifically, the operation valves 56 are connected to the delivery fluid passage 40 and are capable of changing the pressure of the pilot fluid (pilot pressure) that is the hydraulic fluid supplied from the delivery fluid passage 40. The operation valves 56 are manipulated by operating the operation member 55 that is common to them, that is, a single operation lever. The operation valves 56 are a first pilot valve 56A, a second pilot valve 56B, a third pilot valve 56C, and a fourth pilot valve 56D.

When the operation member 55 is swung forward as one of the front-rear direction (first direction), that is, when the operation member 55 is operated forward, the pressure of the pilot fluid which the first pilot valve 56A outputs changes in accordance with an amount of the forward operation. When the operation member 55 is swung rearward as the other of the front-rear direction (first direction), that is, when the operation member 55 is operated rearward, the pressure of the pilot fluid which the second pilot valve 56B outputs changes in accordance with an amount of the rearward operation.

When the operation member 55 is swung leftward as one of the left-right direction (second direction), that is, when the operation member 55 is operated leftward, the pressure of the pilot fluid which the third pilot valve 56C outputs changes in accordance with an amount of the leftward operation. When the operation member 55 is swung rightward as the other of the left-right direction (second direction), that is, when the operation member 55 is operated rightward, the pressure of the pilot fluid which the fourth pilot valve 56D outputs changes in accordance with an amount of the rightward operation.

As illustrated in FIG. 1, the plurality of operation valves 56 is connected to the traveling pump 50 through a traveling fluid passage 42. That is, the traveling pump 50 is a hydraulic device that is operable using the pilot fluid outputted from the operation valve 56 (the first pilot valve 56A, the second pilot valve 56B, the third pilot valve 56C, and the fourth pilot valve 56D).

As illustrated in FIG. 1, the traveling fluid passage 42 is a fluid passage for connection between the plurality of operation valves 56 and the traveling pump 50. The traveling fluid passage 42 includes a first traveling fluid passage 42*a*, a second traveling fluid passage 42*b*, a third traveling fluid passage 42*c*, a fourth traveling fluid passage 42*d*, and a fifth traveling fluid passage 42*e*.

The first traveling fluid passage 42*a* is a fluid passage connected to the forward traveling pressure receiver 50*a* of the first traveling pump SOL. The second traveling fluid passage 42*b* is a fluid passage connected to the rearward traveling pressure receiver 50*b* of the first traveling pump 50L. The third traveling fluid passage 42*c* is a fluid passage connected to the forward traveling pressure receiver 50*a* of the second traveling pump 50R. The fourth traveling fluid passage 42*d* is a fluid passage connected to the rearward traveling pressure receiver 50*b* of the second traveling pump 50R. The fifth traveling fluid passage 42*e* is a fluid passage for connection of the plurality of operation valves 56 to the first traveling fluid passage 42*a*, the second traveling fluid passage 42*b*, the third traveling fluid passage 42*c*, and the fourth traveling fluid passage 42*d*. More specifically, the fifth traveling fluid passage 42*e* includes a bridge portion 42*e*1, which is connected to the first traveling fluid passage 42*a*, the second traveling fluid passage 42*b*, the third traveling fluid passage 42*c*, and the fourth traveling fluid passage 42*d* and has a plurality of shuttle valves 43, and a coupling passage 42*e*2, which is a passage for connection between a junction of the bridge portion 42*e*1 and the plurality of operation valves 56.

When the operation member 55 is swung forward (in the direction indicated by the arrow A1 in FIG. 1), the first pilot valve 56A is manipulated, and the first pilot valve 56A outputs a pilot fluid. The pressure of the pilot fluid outputted from the first pilot valve 56A (pilot pressure) acts on the forward traveling pressure receiver 50*a* of the first traveling pump SOL through the fifth traveling fluid passage 42*e* and the first traveling fluid passage 42*a*. In addition, the pressure of the pilot fluid outputted from the first pilot valve 56A (pilot pressure) acts on the forward traveling pressure receiver 50*a* of the second traveling pump SOR through the fifth traveling fluid passage 42*e* and the third traveling fluid passage 42*c*. This changes the swash-plate angles of the first traveling pump SOL and the second traveling pump SOR to cause the first traveling motor 51L and the second traveling motor 51R to operate in the normal direction of rotation (toward the forward rotation side), thereby causing the working machine 1 to travel straight forward.

When the operation member 55 is swung rearward (in the direction indicated by the arrow A2 in FIG. 1), the second pilot valve 56B is manipulated, and the second pilot valve 56B outputs a pilot fluid. The pressure of the pilot fluid outputted from the second pilot valve 56B (pilot pressure) acts on the rearward traveling pressure receiver 50*b* of the first traveling pump 50L through the fifth traveling fluid passage 42*e* and the second traveling fluid passage 42*b*. In addition, the pressure of the pilot fluid outputted from the second pilot valve 56B (pilot pressure) acts on the rearward traveling pressure receiver 50*b* of the second traveling pump 50R through the fifth traveling fluid passage 42*e* and the fourth traveling fluid passage 42*d*. This changes the swash-plate angles of the first traveling pump 50L and the second traveling pump SOR to cause the first traveling motor 51L and the second traveling motor 51R to operate in the reverse direction of rotation (toward the rearward rotation side), thereby causing the working machine 1 to travel straight rearward.

When the operation member 55 is swung leftward (in the direction indicated by the arrow A3 in FIG. 1), the third pilot valve 56C is manipulated, and the third pilot valve 56C outputs a pilot fluid. The pressure of the pilot fluid outputted from the third pilot valve 56C (pilot pressure) acts on the forward traveling pressure receiver 50*a* of the second traveling pump SOR through the fifth traveling fluid passage 42*e* and the third traveling fluid passage 42*c*. In addition, the pressure of the pilot fluid outputted from the third pilot valve 56C (pilot pressure) acts on the rearward traveling pressure receiver 50*b* of the first traveling pump SOL through the fifth traveling fluid passage 42*e* and the second traveling fluid passage 42*b*. This changes the swash-plate angles of the first traveling pump SOL and the second traveling pump SOR to cause the first traveling motor 51L to operate in the reverse direction of rotation and the second traveling motor 51R to operate in the normal direction of rotation, thereby causing the working machine 1 to make a turn to the left.

When the operation member 55 is swung rightward (in the direction indicated by the arrow A4 in FIG. 1), the fourth pilot valve 56D is manipulated, and the fourth pilot valve 56D outputs a pilot fluid. The pressure of the pilot fluid outputted from the fourth pilot valve 56D (pilot pressure) acts on the forward traveling pressure receiver 50*a* of the first traveling pump SOL through the fifth traveling fluid passage 42*e* and the first traveling fluid passage 42*a*. In addition, the pressure of the pilot fluid outputted from the fourth pilot valve 56D (pilot pressure) acts on the rearward traveling pressure receiver 50*b* of the second traveling pump SOR through the fifth traveling fluid passage 42*e* and the fourth traveling fluid passage 42*d*. This changes the swash-plate angles of the first traveling pump 50L and the second traveling pump 50R to cause the first traveling motor 51L to operate in the normal direction of rotation and the second traveling motor 51R to operate in the reverse direction of rotation, thereby causing the working machine 1 to make a turn to the right.

When the operation member 55 is swung in an oblique direction, the rotation direction and the rotation speed of each of the first traveling motor 51L and the second traveling motor 51R are determined based on differential pressure between the pilot pressure acting on the forward traveling pressure receiver 50*a* and the pilot pressure acting on the rearward traveling pressure receiver 50*b*, and the working machine 1 makes a turn to the right or a turn to the left while traveling forward or rearward.

More specifically, when the operation member 55 is swung obliquely forward to the left, the working machine 1 makes a turn to the left while traveling forward at a speed corresponding to the swing angle of the operation member 55. When the operation member 55 is swung obliquely forward to the right, the working machine 1 makes a turn to the right while traveling forward at a speed corresponding to the swing angle of the operation member 55. When the operation member 55 is swung obliquely rearward to the left, the working machine 1 makes a turn to the left while traveling rearward at a speed corresponding to the swing angle of the operation member 55. When the operation member 55 is swung obliquely rearward to the right, the working machine 1 makes a turn to the right while traveling rearward at a speed corresponding to the swing angle of the operation member 55.

As illustrated in FIG. 1, the working machine 1 includes a traveling switching valve 57. The traveling switching valve 57 is switchable between a first state, in which the rotation speed (number of revolutions) of the traveling motor 51 is set to the first speed, and a second state, in which the rotation speed (number of revolutions) of the traveling motor 51 is set to the second speed. The traveling switching valve 57 includes first switching valves 58L and 58R and a second switching valve 59.

The first switching valve 58L is a two-position switching valve switchable between a first position 58L1 and a second position 58L2. The first switching valve 58L is connected to the swash plate switching cylinder 52L through a fluid passage. The first switching valve 58L, when put into the first position 58L1, stops hydraulic fluid supply to the swash plate switching cylinder 52L, thereby making the swash plate switching cylinder 52L retracted. The first switching valve 58L, when put into the second position 58L2, supplies a hydraulic fluid to the swash plate switching cylinder 52L, thereby making the swash plate switching cylinder 52L extended.

The first switching valve 58R is a two-position switching valve switchable between a first position 58R1 and a second position 58R2. The first switching valve 58R is connected to the swash plate switching cylinder 52R through a fluid passage. The first switching valve 58R, when put into the first position 58R1, stops hydraulic fluid supply to the swash plate switching cylinder 52R, thereby making the swash plate switching cylinder 52R retracted. The first switching valve 58R, when put into the second position 58R2, supplies a hydraulic fluid to the swash plate switching cylinder 52R, thereby making the swash plate switching cylinder 52R extended.

The second switching valve 59 is a solenoid valve configured to switch the position of the first switching valve 58L and the position of the first switching valve 58R. Specifically, the second switching valve 59 is a two-position switching valve switchable between a first position 59*a* and a second position 59*b* by energization. As illustrated in FIG. 1, the second switching valve 59 is connected to the first switching valves 58L and 58R through a fluid passage 41. The second switching valve 59, when put into the first position 59*a*, supplies a hydraulic fluid to a pressure receiver of the first switching valve 58L and a pressure receiver of the first switching valve 58R to switch the first switching valve 58L to the first position 58L1 and switch the first switching valve 58R to the first position 58R1. The second switching valve 59, when put into the second position 59*b*, stops the supply of the hydraulic fluid to the pressure receiver of the first switching valve 58L and the pressure receiver of the first switching valve 58R to switch the first switching valve 58L to the second position 58L2 and switch the first switching valve 58R to the second position 58R2.

That is, when the second switching valve 59 is put into the first position 59*a*, the traveling switching valve 57 is put into the first state, the swash plate switching cylinders 52L and 52R are retracted, and the rotation speed of the traveling motor 51 (the first traveling motor 51L and the second traveling motor 51R) is switched to the first speed. When the second switching valve 59 is put into the second position 59*b*, the traveling switching valve 57 is put into the second state, the swash plate switching cylinders 52L and 52R are extended, and the rotation speed of the traveling motor 51 (the first traveling motor 51L and the second traveling motor 51R) is switched to the second speed.

Therefore, the traveling switching valve 57 is capable of switching the traveling motor 51 (the first traveling motor 51L and the second traveling motor 51R) between the first speed and the second speed.

As illustrated in FIG. 1, the working machine 1 includes a switching actuator (speed operation actuator) 101 operable by the operator or the like. The switching actuator 101 is a selector switch to be operated for switching the traveling motor 51 (the first traveling motor 51L and the second traveling motor 51R) between the first speed and the second speed. The switching actuator 101 is connected to the controller 100, is operated by the operator or the like, and inputs an operation signal into the controller 100. Based on switching operation of the switching actuator 101, the controller 100 outputs a control signal (for example, a voltage, a current, etc.) to the traveling switching valve 57 to switch the traveling switching valve 57 between the first state and the second state.

In this way, the switching actuator (selector switch) 101 can be operated for switching the traveling switching valve 57 from the first state to the second state and for switching the traveling switching valve 57 from the second state to the first state. That is, the switching actuator 101 can be operated for shift-up switching of switching the traveling motor 51 (the first traveling motor 51L and the second traveling motor 51R) from the first speed (first state) to the second speed (second state) and for shift-down switching of switching the traveling motor 51 (the first traveling motor 51L and the second traveling motor 51R) from the second speed (second state) to the first speed (first state).

The working machine 1 according to the present disclosure is capable of reducing the output of the hydraulic devices S (the traveling pump 50 and the traveling motor 51) and thereby suppressing engine stall. Specifically, the working machine 1 suppresses engine stall by reducing the output of the hydraulic devices S by changing the pilot pressure (primary pressure) of the pilot fluid supplied to the operation valves 56. Anti-stall control will now be explained in detail.

As illustrated in FIG. 1, the working machine 1 includes a number-of-revolutions operation actuator (accelerator) 102 and a second detector 103. The number-of-revolutions operation actuator 102 is a member for operating a target number of revolutions of the prime mover 6. The number-of-revolutions operation actuator 102 is connected to the controller 100 and inputs an operation signal into the controller 100. The number-of-revolutions operation actuator 102 is provided near the operator's seat 8. The number-of-revolutions operation actuator 102 is an accelerator lever supported pivotally, an accelerator pedal supported pivotally, an accelerator potentiometer supported rotatably, an accelerator slider supported slidably, or the like. The number-of-revolutions operation actuator 102 is not limited to these examples. Any member, etc. may be adopted as long as it can be used for operating a target number of revolutions of the prime mover 6.

The second detector 103 is, for example, a sensor configured to detect an actual number of revolutions of the prime mover 6. The second detector 103 is connected to the controller 100 and inputs a signal that is based on the detection (a detection signal) into the controller 100.

Based on the difference between the target number of revolutions of the prime mover 6 operated using the number-of-revolutions operation actuator 102 and the actual number of revolutions of the prime mover 6 detected by the second detector 103 (referred to as "drop in number of revolutions"), the controller 100 performs control for suppressing the stopping of the prime mover 6, that is, control for suppressing engine stall (anti-stall control). In the present embodiment, in anti-stall control, the controller 100 suppresses engine stall by reducing the output of the traveling pump 50 in a case where the drop in number of revolutions is not less than a first threshold.

As illustrated in FIG. 1, the working machine 1 includes an actuation valve 70. The actuation valve 70 is a valve capable of changing the pilot pressure of the pilot fluid for actuating the traveling pump 50. The actuation valve 70 is provided on the delivery fluid passage 40 and changes the pilot pressure (primary pressure) of the pilot fluid supplied from the delivery fluid passage 40 to the manipulator 54 (the plurality of operation valves 56).

The actuation valve 70 operates based on a control signal (for example, a voltage, a current, etc.) of the controller 100 and, by changing its opening, changes the pilot pressure (primary pressure) of the pilot fluid supplied from the delivery fluid passage 40 to the manipulator 54. A case where the control signal of the controller 100 is a current will be described below. In the description below, the value of the current outputted as the control signal of the controller 100 will be referred to as "instruction current value". A proportional solenoid valve configured as the actuation valve 70 is capable of increasing its opening in proportion to the instruction current value.

That is, the primary pressure changes according to the control signal outputted from the controller 100 to the actuation valve 70. In the present embodiment, since the controller 100 outputs the instruction current value to the actuation valve 70, the primary pressure changes according to the instruction current value outputted from the controller 100 to the actuation valve 70. Specifically, when the instruction current value outputted by the controller 100 to the actuation valve 70 increases, the opening of the actuation valve 70 increases, and the primary pressure increases. When the instruction current value outputted by the controller 100 to the actuation valve 70 decreases, the opening of the actuation valve 70 decreases, and the primary pressure decreases.

Figure 2:
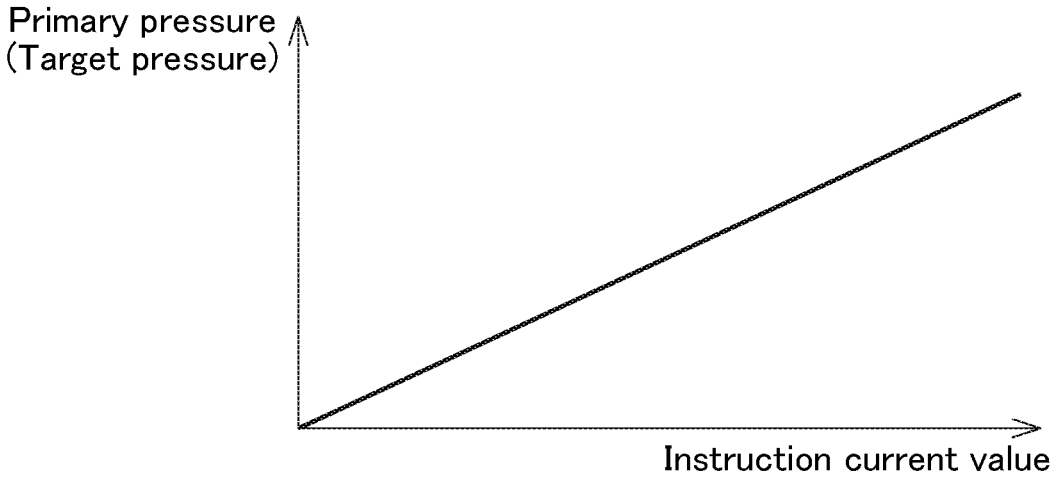
FIG. 2 is a diagram illustrating a relation between a control signal (instruction current value) and primary pressure.

FIG. 2 is a diagram illustrating a relation between the control signal (instruction current value) and the primary pressure. As illustrated in FIG. 2, there is a proportional relation, or a correspondence close to a proportional relation (correlation), between the instruction current value and the primary pressure. Therefore, by changing the instruction current value that is the value of the control signal outputted to the actuation valve 70, the controller 100 is capable of changing the target pressure of the pilot pressure (primary pressure) of the pilot fluid supplied to the plurality of operation valves 56.

As illustrated in FIG. 1, the controller 100 includes a processor 100*b*, which is configured in the form of an electric/electronic circuit provided in the controller 100, a program stored in a CPU, or the like.

The processor 100*b* computes the drop in number of revolutions by subtracting the actual number of revolutions of the prime mover 6 detected by the second detector 103 from the target number of revolutions of the prime mover 6 operated using the number-of-revolutions operation actuator 102. In addition, based on the actual number of revolutions of the prime mover 6 detected by the second detector 103 and the computed drop in number of revolutions, the processor 100*b* defines the control signal (instruction current value) outputted to the actuation valve 70. The processor 100*b* acquires a control map pre-stored in the storage unit 100*a* and refers to a setting line L prescribed in the control map.

Figure 3:
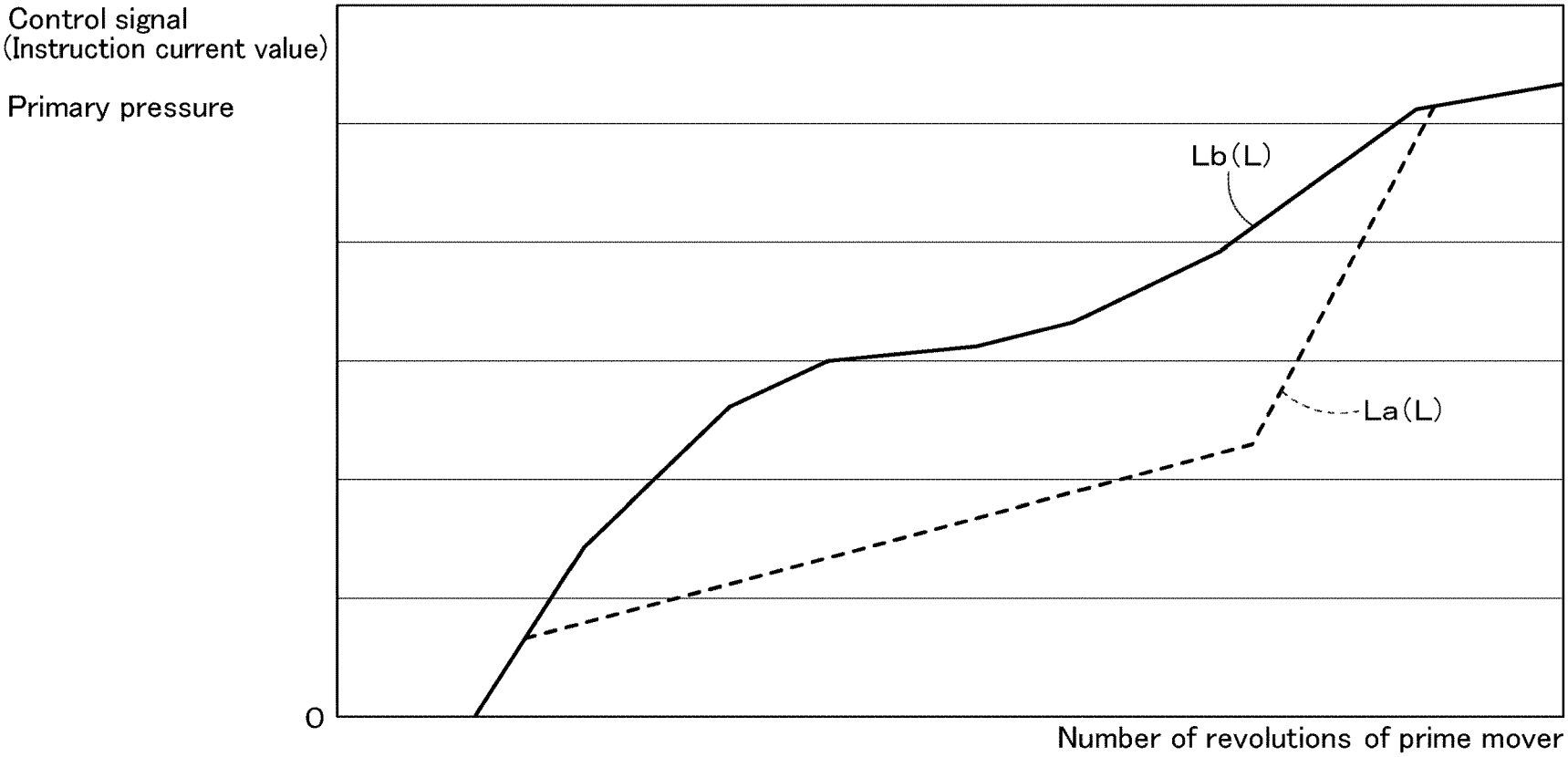
FIG. 3 is a diagram illustrating an example of a setting line for a control signal (target pressure of primary pressure) based on an actual number of revolutions of a prime mover.

A control map containing the setting line L is stored in the storage unit 100*a*. FIG. 3 is a diagram illustrating an example of the setting line L for the control signal (the target pressure of the primary pressure) based on the actual number of revolutions of the prime mover 6. The setting line L is a function for the processor 100*b* (controller 100) to define the control signal, based on the actual number of revolutions of the prime mover 6 detected by the second detector 103. The setting line L is prescribed based on a relation between the instruction current value and the actual number of revolutions of the prime mover 6 when the operation valve 56 is fully open. In the example illustrated in FIG. 3, a control map showing an example of the setting line L (anti-stall map) is depicted. The setting line L includes a first line La and a second line Lb.

As has been described above, there is a correspondence such as one close to a proportional relation between the instruction current value that is the value of the control signal outputted by the controller 100 to the actuation valve 70 and the target pressure of the primary pressure (see FIG. 2). That is, the setting line L (the first line La and the second line Lb) illustrated in FIG. 3 can be paraphrased as a setting line L for defining the target pressure of the primary pressure corresponding to the control signal (instruction current value) based on the actual number of revolutions of the prime mover 6. Therefore, the vertical axis of FIG. 3 may be labeled as "control signal (instruction current value)" or as "primary pressure (target pressure)".

The first line La is a curve for, based on the actual number of revolutions, setting the control signal (instruction current value) corresponding to the target pressure of the primary pressure in a case where the drop in number of revolutions computed by the processor 100*b* is not less than the first threshold. That is, the first line La is a drop characteristic curve to be used when a traveling load not lighter than a predetermined load is applied to the prime mover 6.

The second line Lb is a curve for, based on the actual number of revolutions, setting the control signal (instruction current value) corresponding to the target pressure of the primary pressure in a case where the drop in number of revolutions computed by the processor 100*b* is less than the first threshold. The second line Lb is a curve for setting the value of the control signal (instruction current value) to be larger than the value set using the first line La. That is, the second line Lb is a light-load characteristic curve to be used when the load applied to the prime mover 6 is lighter than the predetermined load.

As illustrated in FIG. 1, the controller 100 includes a changer 100*c*. The changer 100*c* is configured in the form of an electric/electronic circuit provided in the controller 100, a program stored in a CPU, or the like. The changer 100*c* changes (corrects) the control signal (instruction current value) computed using the first line La such that the opening of the actuation valve 70 will increase as the actual number of revolutions of the traveling motor 51 decreases in a case where the drop in number of revolutions computed by the processor 100*b* is not less than the first threshold. The changer 100*c* may change the control signal based on the actual number of revolutions of the prime mover 6 in addition to the actual number of revolutions of the traveling motor 51. More specifically, the changer 100*c* changes the control signal in a case where the target number of revolutions of the prime mover 6 operated using the number-of-revolutions operation actuator 102 is not less than a predetermined fourth threshold and, in addition, where the actual number of revolutions of the prime mover 6 is not less than a fifth threshold. The fourth threshold and the fifth threshold are preset values. The fourth threshold is defined as a value falling within a range from middle revolution to high revolution regarding the target number of revolutions of the prime mover 6. The fifth threshold is defined as a value corresponding to, for example, the minimum value of the actual number of revolutions of the prime mover 6 required for the traveling of the working machine 1. The fourth threshold and the fifth threshold may be configured to be changeable by operating an operation switch connected to the controller 100, operating a terminal, or the like.

In the present embodiment, the changer 100*c* changes the control signal based on both the actual number of revolutions of the traveling motor 51 and the target number of revolutions of the prime mover 6; however, in a case where the changer 100*c* changes the control signal based on the actual number of revolutions of the traveling motor 51 only, the changer 100*c* may change the control signal regardless of the target number of revolutions of the prime mover 6 if the target number of revolutions of the prime mover 6 operated using the number-of-revolutions operation actuator 102 is not less than the predetermined fourth threshold. Changing the instruction current value by the changer 100*c* will now be explained in detail.

As illustrated in FIG. 1, the working machine 1 includes a first detector 104. The first detector 104 is, for example, a sensor configured to detect the actual number of revolutions of the traveling motor 51 (actual motor rev.). The first detector 104 is connected to the controller 100 and inputs a signal that is based on the detection (a detection signal) into the controller 100. When the working machine 1 is equipped with a plurality of motors as the traveling motor 5, it is possible to detect the actual number of revolutions of each of them. In the present embodiment, the traveling motor 51 includes the first traveling motor 51L and the second traveling motor 51R; therefore, the first detector 104 is mounted on each of the first traveling motor 51L and the second traveling motor 51R. The first detector (a first revolution sensor) 104 mounted on the first traveling motor 51L detects the actual number of revolutions of the first traveling motor 51L. The first detector (a second revolution sensor) 104 mounted on the second traveling motor 51R detects the actual number of revolutions of the second traveling motor 51R.

Based on the detection signals inputted from the first detector 104 (the first revolution sensor and the second revolution sensor) into the controller 100, the changer 100*c* computes the actual number of revolutions of the first traveling motor 51L and the actual number of revolutions of the second traveling motor 51R respectively. In the present embodiment, the changer 100*c* computes the actual number of revolutions of the traveling motor 51 without making a distinction between the number of revolutions at the time of normal rotation and the number of revolutions at the time of reverse rotation. For example, if the actual number of revolutions in a case of normal rotation of the traveling motor 51 is defined to be positive and the actual number of revolutions in a case of reverse rotation of the traveling motor 51 is defined to be negative, the changer 100*c* computes an absolute value of the actual number of revolutions of the traveling motor 51.

The changer 100*c* computes a moving average of the actual number of revolutions of the first traveling motor 51L and a moving average of the actual number of revolutions of the second traveling motor 51R respectively by performing moving-average calculation on the same number of pieces (n pieces) of data of the computed actual number of revolutions of the first traveling motor 51L and the computed actual number of revolutions of the second traveling motor 51R respectively. The changer 100*c* adopts the moving average of the actual number of revolutions of the first traveling motor 51L or the moving average of the actual number of revolutions of the second traveling motor 51R, whichever is less, as the actual number of revolutions of the traveling motor 51. Then, based on the moving average of the actual number of revolutions of the first traveling motor 51L or the moving average of the actual number of revolutions of the second traveling motor 51R, whichever is less, the changer 100*c* changes the control signal.

In the description below, the moving average adopted by the changer 100*c*, namely, the moving average of the actual number of revolutions of the first traveling motor 51L or the moving average of the actual number of revolutions of the second traveling motor 51R, whichever is less, will be simply referred to as "the actual number of revolutions of the traveling motor 51".

In the present embodiment, it is sufficient as long as the changer 100*c* changes the control signal based on the actual number of revolutions of the traveling motor 51. In the present embodiment, for example, the changer 100*c* may adopt the actual number of revolutions of the first traveling motor 51L or the actual number of revolutions of the second traveling motor 51R, whichever is less, as the actual number of revolutions of the traveling motor 51 without computing the moving average of the actual number of revolutions of the first traveling motor 51L and the moving average of the actual number of revolutions of the second traveling motor 51R.

Figure 4A:
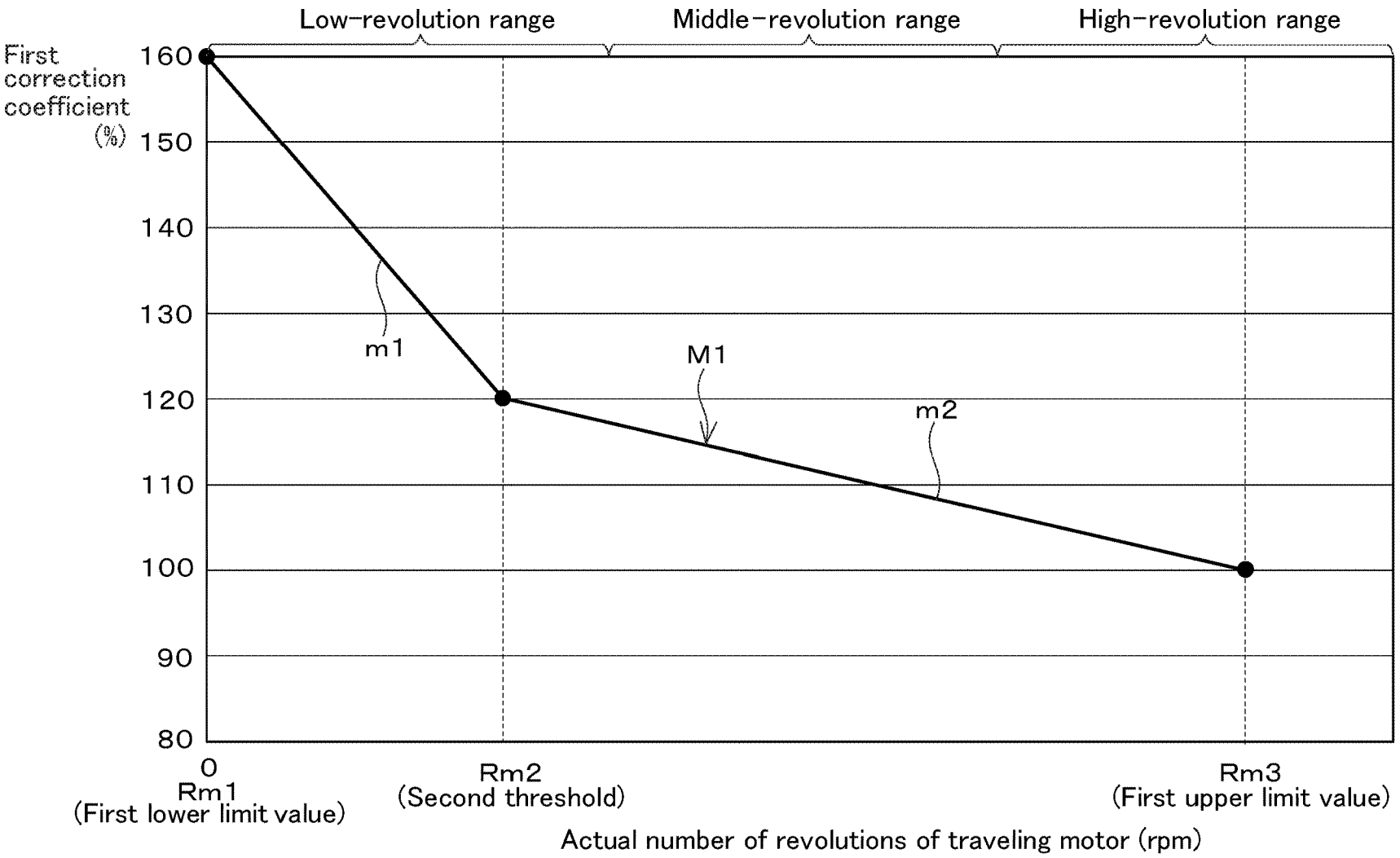
FIG. 4A is a diagram illustrating an example of a first function specifying a relation between an actual number of revolutions of a traveling motor and a first correction coefficient.

Based on a first correction coefficient (gain value) defined in relation to the actual number of revolutions of the traveling motor 51, the changer 100*c* changes the control signal expressed by the first line La. Specifically, a first function M1 specifying a relation between the actual number of revolutions of the traveling motor 51 and the first correction coefficient is stored in the storage unit 100*a*, and the changer 100*c* calculates the first correction coefficient by substituting the actual number of revolutions of the traveling motor 51 detected by the first detector 104 into the first function M1. In the present embodiment, the changer 100*c* calculates the first correction coefficient by substituting the actual number of revolutions of the traveling motor 51 adopted based on a comparison of the moving average of the actual number of revolutions of the first traveling motor 51L and the moving average of the actual number of revolutions of the second traveling motor 51R into the first function M1. FIG. 4A is a diagram illustrating an example of the first function M1 specifying a relation between the actual number of revolutions of the traveling motor 51 and the first correction coefficient.

As illustrated in FIG. 4A, the first function M1 defines the first correction coefficient in terms of value that is not less than one, wherein a definition is given such that the first correction coefficient corresponding to a second number of revolutions, which represents the actual number of revolutions of the traveling motor 51 and is less than a first number of revolutions, is greater than the first correction coefficient corresponding to the first number of revolutions, which represents the actual number of revolutions of the traveling motor 51. Each of the first number of revolutions and the second number of revolutions is any number of revolutions within a range specified by the first function M1, and the first number of revolutions is greater than the second number of revolutions. In other words, as expressed by the first function M1, the first correction coefficient is equal to or greater than one, decreases as the actual number of revolutions of the traveling motor 51 increases, and increases as the actual number of revolutions of the traveling motor 51 decreases. That is, since the first correction coefficient is equal to or greater than one and is never less than one, the first correction coefficient is a coefficient based on which it is possible to correct the control signal (instruction current value) expressed by the first line La to make it greater. Therefore, with the first function M1, the changer 100*c* is capable of increasing the opening of the actuation valve 70 by performing the correction such that the instruction current value increases as the actual number of revolutions of the traveling motor 51 decreases. That is, the changer 100*c* is capable of increasing the consumption horsepower of the traveling pump 50 by increasing the primary pressure as the actual number of revolutions of the traveling motor 51 decreases.

As illustrated in FIG. 4A, the first function M1 has different degrees of inclination with respect to a second threshold Rm2 of the actual number of revolutions of the traveling motor 51. The degree of inclination of the first function M1 in a range where the actual number of revolutions of the traveling motor 51 is not greater than the second threshold Rm2 is greater than the degree of inclination of the first function M1 in a range where the actual number of revolutions of the traveling motor 51 is not less than the second threshold Rm2 In other words, the first function M1 is sloped steeper when the actual number of revolutions of the traveling motor 51 is less than the second threshold Rm2 than when the actual number of revolutions of the traveling motor 51 is greater than the second threshold Rm2.

This means that, on the first function M1, the first correction coefficient decreases with a greater amount of decrease when the actual number of revolutions of the traveling motor 51 increases from zero toward the second threshold Rm2 than when the actual number of revolutions of the traveling motor 51 increases from the second threshold Rm2 To put it the other way around, on the first function M1, the first correction coefficient increases with a greater amount of increase when the actual number of revolutions of the traveling motor 51 decreases from the second threshold Rm2 toward zero than when the actual number of revolutions of the traveling motor 51 decreases toward the second threshold Rm2.

In the present embodiment, the first function M1 is defined to have its range in which the actual number of revolutions of the traveling motor 51 is not less than a first lower limit value Rm1 and is not greater than a first upper limit value Rm3, and the second threshold Rm2 is defined as a value between the first lower limit value Rm1 and the first upper limit value Rm3. That is, a part of the first function M1 where the actual number of revolutions of the traveling motor 51 is not greater than the second threshold Rm2 (a first part) is a partial section where the actual number of revolutions of the traveling motor 51 is not less than the first lower limit value Rm1 and is not greater than the second threshold Rm2 (a first section m1). A part of the first function M1 where the actual number of revolutions of the traveling motor 51 is not less than the second threshold Rm2 (a second part) is a partial section where the actual number of revolutions of the traveling motor 51 is not less than the second threshold Rm2 and is not greater than the first upper limit value Rm3 (a second section m2).

The first lower limit value Rm1 corresponds to the minimum value of the actual number of revolutions of the traveling motor 51. In the present embodiment, the first lower limit value Rm1 is zero. The first upper limit value Rm3 corresponds to the maximum value of the actual number of revolutions of the traveling motor 51. For example, the first upper limit value Rm3 corresponds to the maximum revolution output capability of the traveling motor 51.

The second threshold Rm2 is a preset value. The first section m1 is defined as a section in which the actual number of revolutions of the traveling motor 51 is comparatively small, meaning a low-revolution range, as in a case where the working machine 1 is performing work such as pushing dirt using its bucket. In the present embodiment, the first section m1 corresponds to a speed range for a case where the traveling motor 51 is operating at the first speed (low-speed range), and the second threshold Rm2 is a value corresponding to any actual number of revolutions in a speed range for a case where the traveling motor 51 is operating at the first speed. The second threshold Rm2 may be configured to be changeable by operating an operation switch connected to the controller 100, operating a terminal, or the like.

In both of the first section m1 and the second section m2, the first correction coefficient is in proportion to the actual number of revolutions of the traveling motor 51. As illustrated in FIG. 4A, on the first function M1, the first correction coefficient is 1.6 (160%) when the actual number of revolutions of the traveling motor 51 is at the first lower limit value Rm1. On the first function M1, the first correction coefficient is 1.2 (120%) when the actual number of revolutions of the traveling motor 51 is at the second threshold Rm2 On the first function M1, the first correction coefficient is 1.0 (100%) when the actual number of revolutions of the traveling motor 51 is at the first upper limit value Rm3.

That is, in the first section m1 of the first function M1 illustrated in FIG. 4A, the first correction coefficient decreases substantially linearly from 1.6 (160%) to 1.2 (120%) as the actual number of revolutions of the traveling motor 51 increases, and increases substantially linearly from 1.2 (120%) to 1.6 (160%) as the actual number of revolutions of the traveling motor 51 decreases.

On the other hand, in the second section m2 of the first function M1 illustrated in FIG. 4A, the first correction coefficient decreases substantially linearly from 1.2 (120%) to 1.0 (100%) as the actual number of revolutions of the traveling motor 51 increases, and increases substantially linearly from 1.0 (100%) to 1.2 (120%) as the actual number of revolutions of the traveling motor 51 decreases.

Therefore, the changer 100*c* is capable of increasing the delivery flow rate of the traveling pump 50 (consumption horsepower of the traveling pump 50) by increasing the output of the traveling pump 50 when the actual number of revolutions of the traveling motor 51 is comparatively small as in a case where of performing work such as pushing dirt. That is, by increasing the consumption horsepower of the traveling pump 50, it is possible to reduce the actual number of revolutions of the prime mover 6 that is in balance with the delivery flow rate of the traveling pump 50. By this means, it is possible to prevent the occurrence of a phenomenon that, in work that involves opening the traveling relief valve 71, for example, when pushing dirt, the consumption horsepower of the traveling pump 50 decreases due to the influence of the swash-plate characteristics of the traveling pump 50, resulting in a large actual number of revolutions of the prime mover 6 that is in balance with the delivery flow rate of the traveling pump 50. Consequently, it is possible to give, to the operator, an operational feeling that the working machine 1 is performing work with sufficient performance when pushing dirt or the like, and it is possible to continue the work by increasing the delivery flow rate of the traveling pump 50 even when there is an increase in traveling load.

Though some values have been described in the above explanation of the first correction coefficient, they are mere illustrative values mentioned just for the purpose of giving an example. The first correction coefficient may be configured to be changeable by operating an operation switch connected to the controller 100, operating a terminal, or the like.

In the present embodiment, a case where the first correction coefficient is in proportion to the actual number of revolutions of the traveling motor 51 both in the first section m1 and in the second section m2 has been taken as an example; however, it is sufficient as long as the first function M1 has different degrees of inclination with respect to a second threshold Rm2 of the actual number of revolutions of the traveling motor 51. That is, the first function M1 may be a substantially "drawing a curve" function.

Figure 4B:
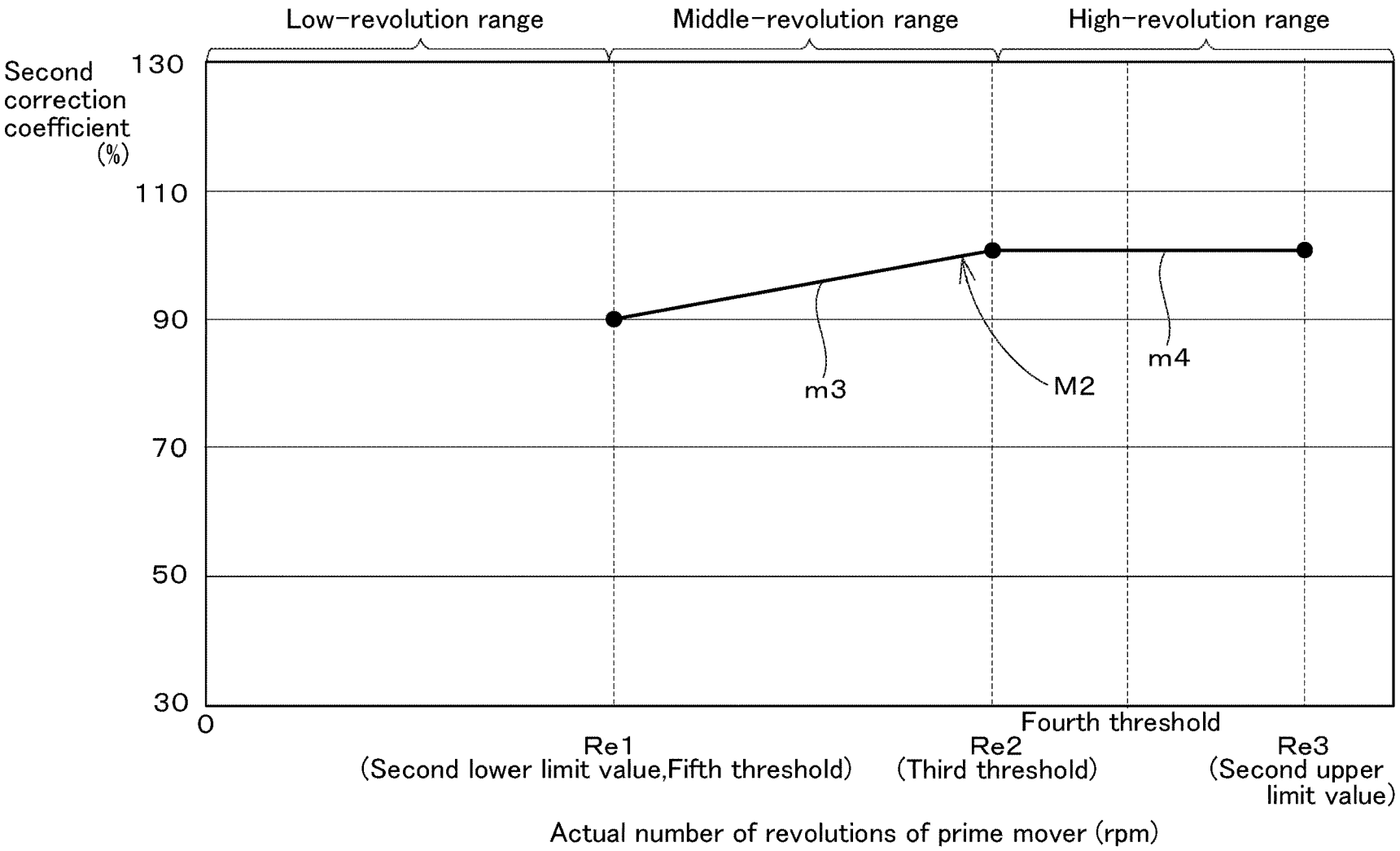
FIG. 4B is a diagram illustrating an example of a second function specifying a relation between the actual number of revolutions of the prime mover and a second correction coefficient.

Based on a second correction coefficient (gain value) defined in relation to the actual number of revolutions of the prime mover 6 in addition to the first correction coefficient, the changer 100*c* changes the control signal expressed by the first line La. Specifically, a second function M2 specifying a relation between the actual number of revolutions of the prime mover 6 and the second correction coefficient is stored in the storage unit 100*a*, and the changer 100*c* calculates the second correction coefficient by substituting the actual number of revolutions of the prime mover 6 detected by the second detector 103 into the second function M2. FIG. 4B is a diagram illustrating an example of the second function M2 specifying a relation between the actual number of revolutions of the prime mover 6 and the second correction coefficient.

As illustrated in FIG. 4B, the second function M2 defines the second correction coefficient as a value equal to one when the actual number of revolutions of the prime mover 6 is not less than a third threshold Re2, and defines the second correction coefficient in terms of value that is less than one when the actual number of revolutions of the prime mover 6 is less than the third threshold Re2. Therefore, according to the second function M2, at least, the changer 100*c* never changes the instruction current value such that the opening of the actuation valve 70 will increase, and is capable of decreasing the opening of the actuation valve 70 when the actual number of revolutions of the prime mover 6 is less than the third threshold Re2 by changing the instruction current value in such a way as to decrease as the actual number of revolutions of the prime mover 6 decreases. That is, when the actual number of revolutions of the prime mover 6 is less than the third threshold Re2, the changer 100*c* is capable of decreasing the consumption horsepower of the traveling pump 50 by reducing the primary pressure as the actual number of revolutions of the prime mover 6 decreases.

In the present embodiment, the second function M2 is defined to have its range in which the actual number of revolutions of the prime mover 6 is not less than a second lower limit value Re1 and is not greater than a second upper limit value Re3, and the third threshold Re2 is defined as a value between the second lower limit value Re1 and the second upper limit value Re3. That is, a part of the second function M2 where the actual number of revolutions of the prime mover 6 is less than the third threshold Re2 (a third part) is a partial section where the actual number of revolutions of the prime mover 6 is not less than the second lower limit value Re1 and is less than the third threshold Re2 (a third section m3). A part of the second function M2 where the actual number of revolutions of the prime mover 6 is not less than the third threshold Re2 (a fourth part) is a partial section where the actual number of revolutions of the prime mover 6 is not less than the third threshold Re2 and is not greater than the second upper limit value Re3 (a fourth section m4).

The second lower limit value Re1 is defined as a value equal to the fifth threshold. That is, in the present embodiment, the second lower limit value Re1 corresponds to, for example, the minimum value of the actual number of revolutions of the prime mover 6 required for the traveling of the working machine 1. The second upper limit value Re3 corresponds to the maximum value of the actual number of revolutions of the prime mover 6. For example, the second upper limit value Re3 corresponds to the maximum revolution output capability of the prime mover 6. The third threshold Re2 is a preset value. The third section m3 is defined as a section in which the actual number of revolutions of the prime mover 6 does not go beyond a middle-revolution range as in a case where the working machine 1 is climbing an ascending slope. In the present embodiment, the third threshold Re2 is defined as a value that is less than the fourth threshold. The third threshold Re2 may be configured to be changeable by operating an operation switch connected to the controller 100, operating a terminal, or the like.

In the third section m3, in which the actual number of revolutions of the prime mover 6 is less than the third threshold Re2, the value of the second correction coefficient is less than one, and the second correction coefficient is in proportion to the actual number of revolutions of the prime mover 6. More specifically, in the third section m3, the second correction coefficient increases as the actual number of revolutions of the prime mover 6 increases, and decreases as the actual number of revolutions of the prime mover 6 decreases. For example, the second correction coefficient is defined to take a value within a range from 0.9 (90%) to 1.0 (100%) in the third section m3 of the second function M2.

In the fourth section m4, in which the actual number of revolutions of the prime mover 6 is not less than the third threshold Re2, the value of the second correction coefficient is one. That is, in the fourth section m4, in which the actual number of revolutions of the prime mover 6 is not less than the third threshold Re2, the changer 100*c* does not change the control signal, based on the second correction coefficient.

That is, in the third section m3 of the second function M2 illustrated in FIG. 4B, the second correction coefficient increases substantially linearly from 0.9 (90%) to 1.0 (100%) as the actual number of revolutions of the prime mover 6 increases, and decreases substantially linearly from 1.0 (100%) to 0.9 (90%) as the actual number of revolutions of the prime mover 6 decreases.

On the other hand, in the fourth section m4 of the second function M2 illustrated in FIG. 4B, the second correction coefficient is constant at 1.0 (100%).

Therefore, when the number of revolutions of the prime mover 6 is less than the third threshold Re2 and is comparatively small, the changer 100*c* is capable of changing the first line La in a direction in which the primary pressure outputted from the actuation valve 70 decreases. By this means, it is possible to reduce the output of the traveling pump 50 and thus prevent the engine from stalling.

Though some values have been described in the above explanation of the second correction coefficient, they are mere illustrative values mentioned just for the purpose of giving an example. The second correction coefficient may be configured to be changeable by operating an operation switch connected to the controller 100, operating a terminal, or the like.

The changer 100*c* changes the control signal expressed by the first line La by means of a third correction coefficient that is based on the first correction coefficient and the second correction coefficient. Specifically, the changer 100*c* computes the third correction coefficient based on a product of the first correction coefficient and the second correction coefficient. In a case where the value of the third correction coefficient computed by the changer 100*c* is greater than one (100%), when the changer 100*c* multiplies the instruction current value by the third correction coefficient, the instruction current value after the change will be greater than the instruction current value before the change. Therefore, in a case where the value of the third correction coefficient acquired by the changer 100*c* is greater than one, the change is made in a direction in which the primary pressure outputted from the actuation valve 70 to which the instruction current value after the change is outputted will become greater than before the change. In a case where the value of the third correction coefficient computed by the changer 100*c* is equal to one (100%), even when the changer 100*c* multiplies the instruction current value by the third correction coefficient, the instruction current value after the change will remain the same.

The changer 100*c* changes the control signal expressed by the first line La in a case where the value of the third correction coefficient is greater than one and does not change the control signal expressed by the first line La in a case where the value of the third correction coefficient is not greater than one. By this means, it is possible to prevent the changer 100*c* from changing the first line La excessively in a direction in which the primary pressure outputted from the actuation valve 70 decreases. That is, it is possible to prevent the traveling power of the traveling motor 51 from being reduced excessively due to changing the first line La by the changer 100*c* when the actual number of revolutions of the prime mover 6 is less than the third threshold Re2.

As described above, in the present embodiment, the changer 100*c* does not change the control signal expressed by the first line La in a case where the value of the third correction coefficient is not greater than one; however, if a higher priority should be given to engine stall suppression, the changer 100*c* may change the control signal expressed by the first line La with multiplication of the instruction current value by the third correction coefficient in a case where the value of the third correction coefficient is not greater than one.

In this "stall-suppression-first" case, when the changer 100*c* multiplies the instruction current value by the third correction coefficient, with the value of the third correction coefficient acquired by the changer 100*c* being less than one (100%), the instruction current value after the change will be less than the instruction current value before the change. Therefore, in a case where the value of the third correction coefficient acquired by the changer 100*c* is less than one, the change is made in a direction in which the primary pressure outputted from the actuation valve 70 to which the instruction current value after the change is outputted will become less than before the change.

Figure 5A:
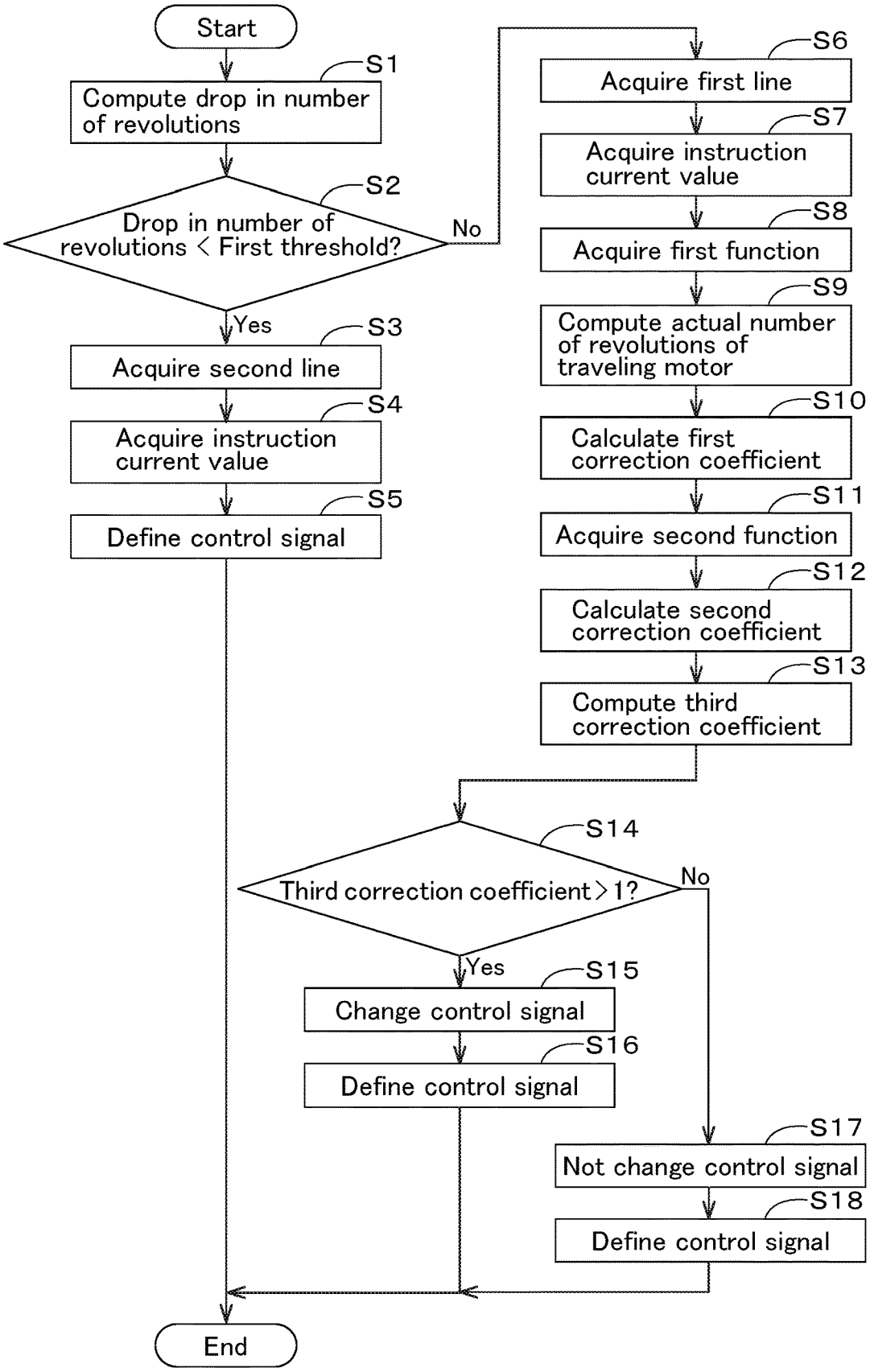
FIG. 5A is an operation flowchart illustrating the flow of operation of a controller for changing the control signal.

FIG. 5A is an operation flowchart illustrating the flow of operation of the controller 100 for changing the control signal (instruction current value). With reference to FIG. 5A, a series of steps for changing the control signal by the controller 100 will now be explained.

First, based on the target number of revolutions of the prime mover 6 operated using the number-of-revolutions operation actuator 102 and the actual number of revolutions of the prime mover 6 detected by the second detector 103, the processor 100*b* computes the drop in number of revolutions (S1). Specifically, the processor 100*b* acquires information on the target number of revolutions of the prime mover 6 operated using the number-of-revolutions operation actuator 102 and the actual number of revolutions of the prime mover 6 detected by the second detector 103, and computes the drop in number of revolutions by subtracting the actual number of revolutions of the prime mover 6 from the target number of revolutions of the prime mover 6.

After computing the drop in number of revolutions (S1), the processor 100*b* checks whether the drop in number of revolutions is less than the first threshold or not (S2). If the drop in number of revolutions is confirmed to be less than the first threshold (S2: Yes), the processor 100*b* acquires the second line Lb from the storage unit 100*a* (S3). After acquiring the second line Lb from the storage unit 100*a* (S3), based on the acquired second line Lb, the processor 100*b* acquires the instruction current value corresponding to the actual number of revolutions detected by the second detector 103 (S4).

After acquiring the instruction current value corresponding to the actual number of revolutions (S4), the processor 100*b* defines the acquired instruction current value as the control signal outputted by the controller 100 to the actuation valve 70 (S5).

On the other hand, if the drop in number of revolutions is confirmed to be not less than the first threshold, namely, if the drop in number of revolutions is confirmed to be equal to or greater than the first threshold (S2: No), the processor 100*b* acquires the first line La from the storage unit 100*a* (S6). After acquiring the first line La from the storage unit 100*a* (S6), based on the acquired first line La, the processor 100*b* acquires the instruction current value corresponding to the actual number of revolutions detected by the second detector 103 (S7).

After the acquisition of the instruction current value corresponding to the actual number of revolutions by the processor 100*b* (S7), the changer 100*c* acquires the first function M1 from the storage unit 100*a* (S8). After acquiring the first function M1 from the storage unit 100*a* (S8), based on a detection signal of the first detector 104, the changer 100*c* computes the actual number of revolutions of the traveling motor 51 (S9). After computing the actual number of revolutions of the traveling motor 51 (S9), the changer 100*c* calculates the first correction coefficient by substituting the actual number of revolutions of the traveling motor 51 into the first function M1 (S10).

After calculating the first correction coefficient (S10), the changer 100*c* acquires the second function M2 from the storage unit 100*a* (S11). After acquiring the second function M2 from the storage unit 100*a* (S11), the changer 100*c* calculates the second correction coefficient by substituting the actual number of revolutions of the prime mover 6 into the second function M2 (S12).

After calculating the second correction coefficient (S12), the changer 100*c* computes the third correction coefficient based on a product of the first correction coefficient and the second correction coefficient (S13). After computing the third correction coefficient (S13), the changer 100*c* checks whether the value of the computed third correction coefficient is greater than one or not (S14).

If the value of the third correction coefficient is confirmed to be greater than one (S14: Yes), the changer 100*c* changes the control signal expressed by the first line La by multiplying the instruction current value having been acquired by the processor 100*b* by the third correction coefficient (S15). After the changing of the control signal by the changer 100*c* (S15), the processor 100*b* defines the instruction current value after the change (control signal after the change) as the control signal outputted by the controller 100 to the actuation valve 70 (S16).

On the other hand, if the value of the third correction coefficient is confirmed to be not greater than one, namely, if the value of the third correction coefficient is confirmed to be equal to or less than one (S14: No), the changer 100*c* does not change the control signal expressed by the first line La by means of the third correction coefficient (S17). That is, the processor 100*b* defines the instruction current value (control signal) expressed by the first line La as the control signal outputted by the controller 100 to the actuation valve 70 (S18).

Figure 5B:
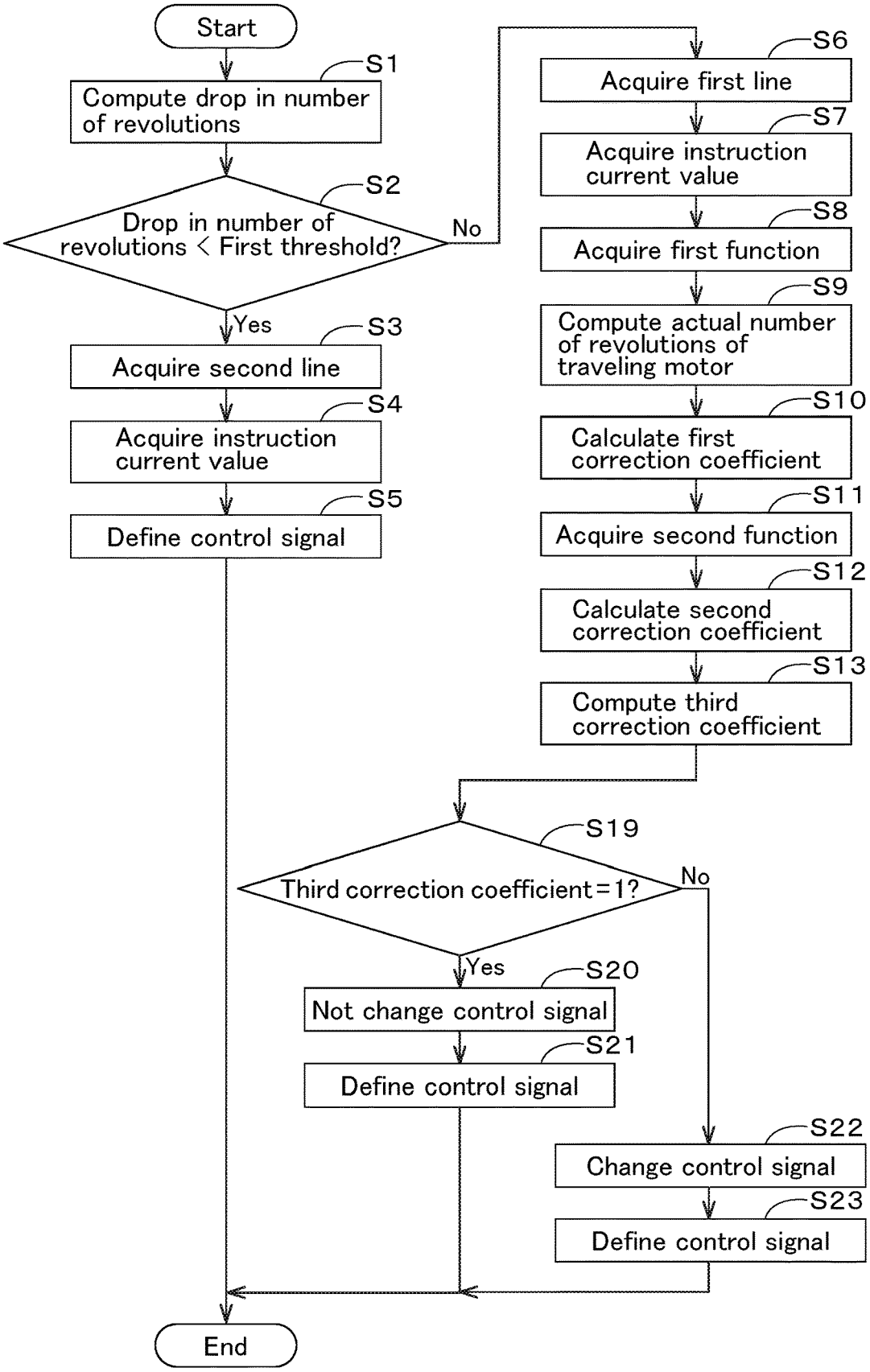
FIG. 5B is an operation flowchart illustrating the flow of operation of the controller for changing the control signal according to a first modification example.

In a modification example in which the changer 100*c* changes the control signal expressed by the first line La in a case where the value of the third correction coefficient is less than one, the controller 100 operates as illustrated in FIG. 5B for correcting the control signal. FIG. 5B is an operation flowchart illustrating the flow of operation of the controller 100 for changing the control signal according to a first modification example. Specifically, as illustrated in FIG. 5B, the flow of operation of the controller 100 according to the modification example is different from the operation flow illustrated in FIG. 5A in that S14 to S18 are replaced with S19 to S23. More specifically, in the modification example illustrated in FIG. 5B, after computing the third correction coefficient (S13), the changer 100*c* checks whether the value of the computed third correction coefficient is equal to one or not (S19).

If the value of the third correction coefficient is confirmed to be equal to one (S19: Yes), the changer 100*c* does not change the control signal expressed by the first line La by means of the third correction coefficient (S20). That is, the processor 100*b* defines the instruction current value expressed by the first line La as the control signal outputted by the controller 100 to the actuation valve 70 (S21).

On the other hand, if the value of the third correction coefficient is confirmed to be not equal to one (S19: No), the changer 100*c* changes the control signal expressed by the first line La by multiplying the instruction current value by the third correction coefficient (S22). After the changing of the control signal by the changer 100*c* (S22), the processor 100*b* defines the instruction current value after the change as the control signal outputted by the controller 100 to the actuation valve 70 (S23).

Figure 4C:
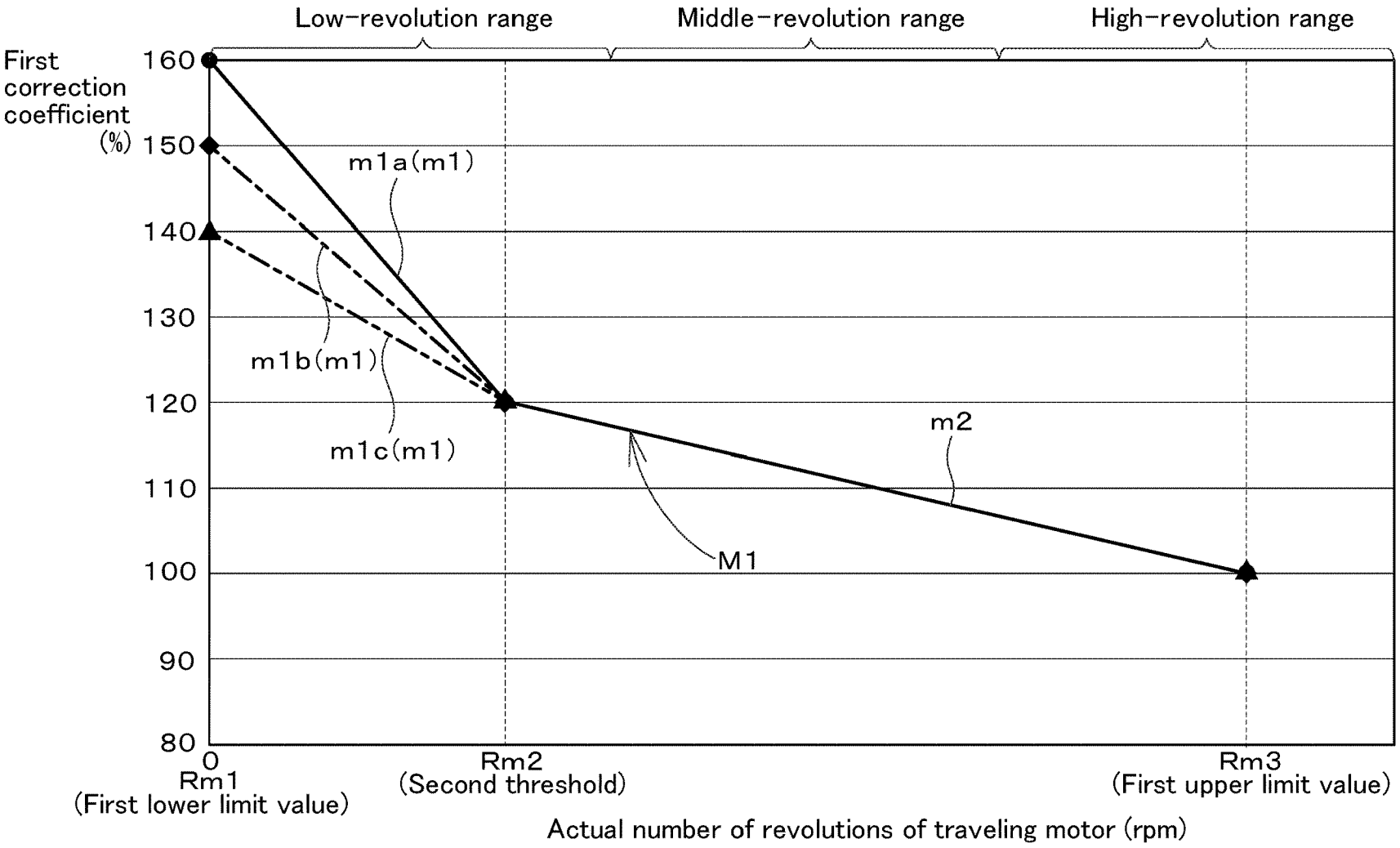
FIG. 4C is a diagram illustrating an example of respective first functions for a plurality of modes in a second modification example.
Figure 4D:
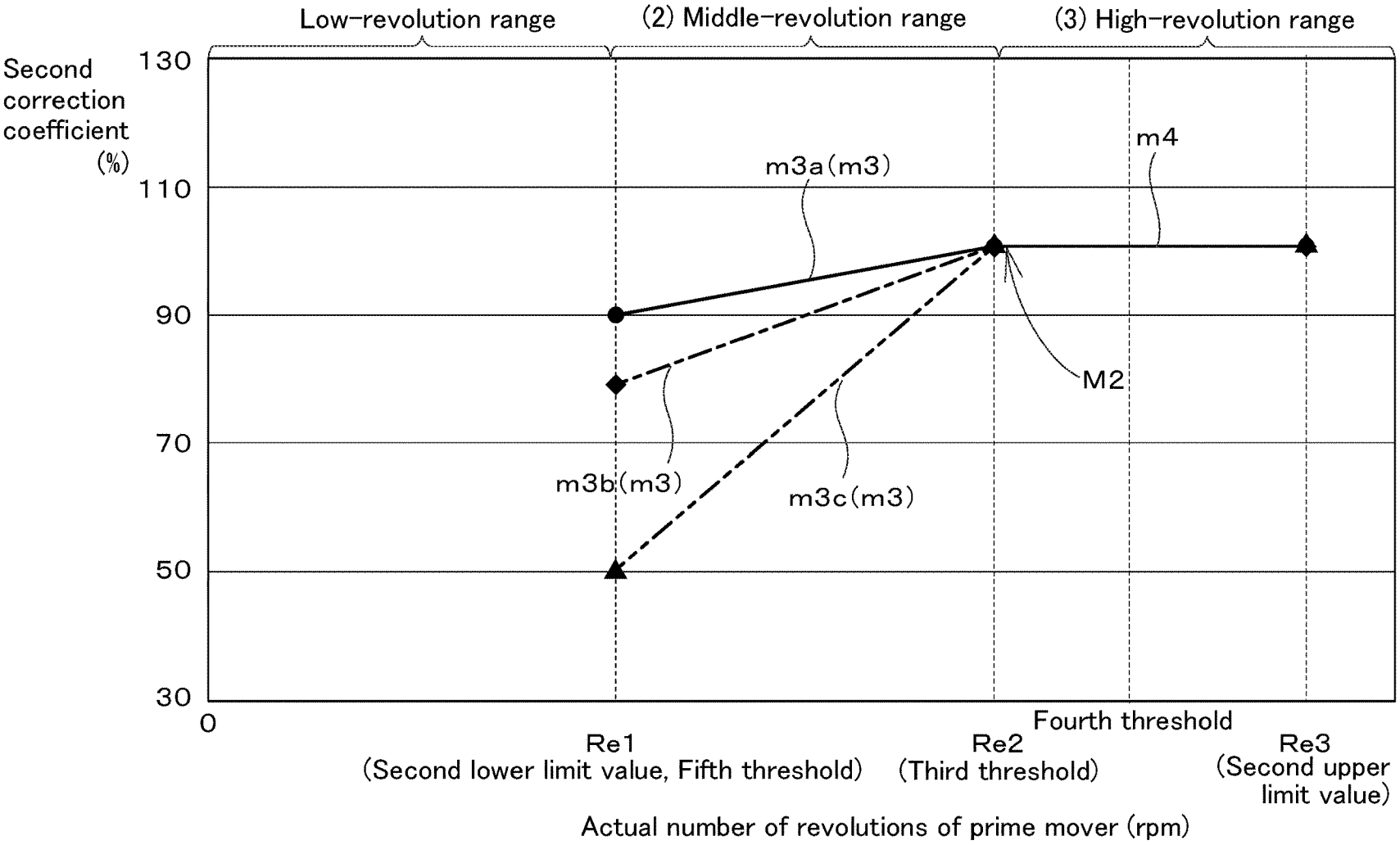
FIG. 4D is a diagram illustrating an example of respective second functions for the plurality of modes in the second modification example.

The controller 100 may be configured to be switchable between a plurality of modes, and the storage unit 100*a* may store a plurality of first functions M1 and a plurality of second functions M2 corresponding to the plurality of modes. FIG. 4C is a diagram illustrating an example of respective first functions M1 for a plurality of modes in a modification example in which the controller 100 is configured to be switchable between the plurality of modes. FIG. 4D is a diagram illustrating an example of respective second functions M2 for the plurality of modes in this modification example. As illustrated in FIG. 4C, the first functions M1 are different from one another in terms of inclination at least partially. As illustrated in FIG. 4C, the second functions M2 are different from one another in terms of inclination at least partially. Based on the first function M1 that corresponds to the mode of the controller 100, the changer 100*c* calculates the first correction coefficient. In addition, based on the second function M2 that corresponds to the mode of the controller 100, the changer 100*c* calculates the second correction coefficient.

That is, configuring the controller 100 to be switchable between plural modes enables the changer 100*c* to change a control signal in a different manner according to the mode. In the description below, a case where both of first and second functions M1 and M2 correspond to a plurality of modes and where a plurality of first functions M1 and a plurality of second functions M2 are stored in the storage unit 100*a* will be taken as an example. The example may be modified such that either first functions M1 only or second functions M2 only correspond to a plurality of modes. In this case, the storage unit 100*a* may store a plurality of first functions M1 corresponding to a plurality of modes and a single second function M2 or store a single first function M1 and a plurality of second functions M2 corresponding to a plurality of modes. The controller 100 may be configured such that mode switching can be performed separately for a plurality of modes corresponding to a plurality of first functions M1 and a plurality of modes corresponding to a plurality of second functions M2. The number of first functions M1 and the number of second functions M2 do not necessarily have to match each other. The combination of them is also not limited.

As illustrated in FIG. 1, the working machine 1 includes a switcher (operation actuator) 105. The switcher 105 is a selector switch operable for switching the mode of the controller 100. The switcher 105 is connected to the controller 100, is operated by the operator or the like, and inputs an operation signal into the controller 100. In the present embodiment, the switcher 105 is a display image displayed on a display 110. The display 110 is a device connected to the controller 100 such that communication can be performed therebetween and configured to display various kinds of information regarding the working machine 1 to assist the traveling and work of the working machine 1. The display 110 is, for example, a traveling assistance device provided near the operator's seat 8. The display 110 is further connected to devices of the working machine 1 such that wired or wireless communication can be performed therebetween, and is therefore capable of transmitting information thereto and receiving information therefrom bidirectionally.

Figure 6:
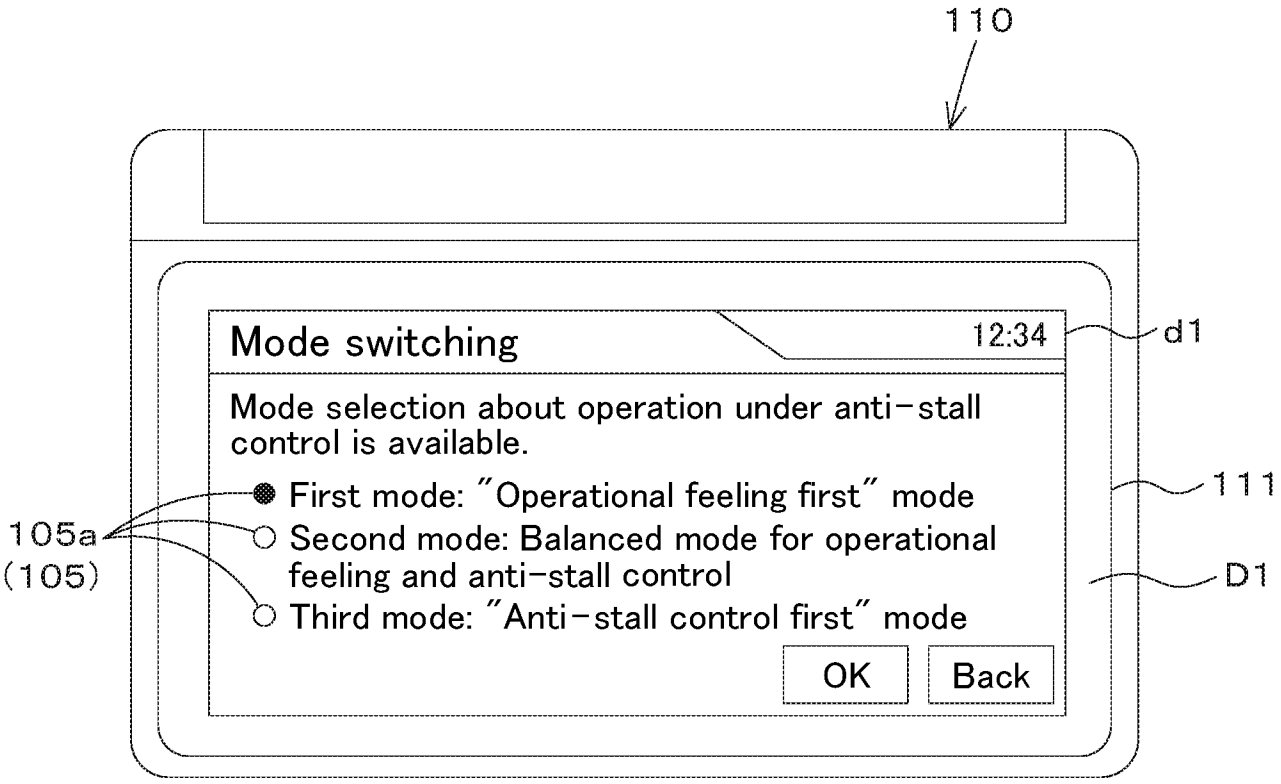
FIG. 6 is a diagram illustrating an example of a display according to the second modification example, and a switching screen displayed on a display unit thereof.

FIG. 6 is a diagram illustrating an example of the display 110 according to the modification example, and a switching screen D1 displayed on its display unit 111. As illustrated in FIG. 6, the display 110 includes the display unit 111. The display unit 111 is any one of a liquid crystal panel, a touch panel, and other kinds of panel. Various kinds of information for assisting the traveling and work of the working machine 1 can be displayed thereon.

In response to predetermined operation performed by the operator, the display unit 111 displays the switching screen D1. The switching screen D1 displays the switcher 105. The switcher 105 includes a plurality of selection buttons 105*a* to accept operation by the operator. In the present embodiment, the operator performs selection operation by touching one of the plurality of selection buttons 105*a* displayed in the switching screen D1. When one of the selection buttons 105*a* is selected by the operator, the display 110 outputs operation information that is based on the selection operation to the controller 100. Though the switcher 105 according to the present embodiment includes the plurality of selection buttons 105*a* displayed on the display unit 111, the switcher 105 may be embodied in any other form as long as it is connected to the controller 100 and enables mode switching operation. For example, the switcher 105 may be a dial connected to the controller 100 and having a plurality of switching positions, a plurality of buttons, etc.

Figure 7:
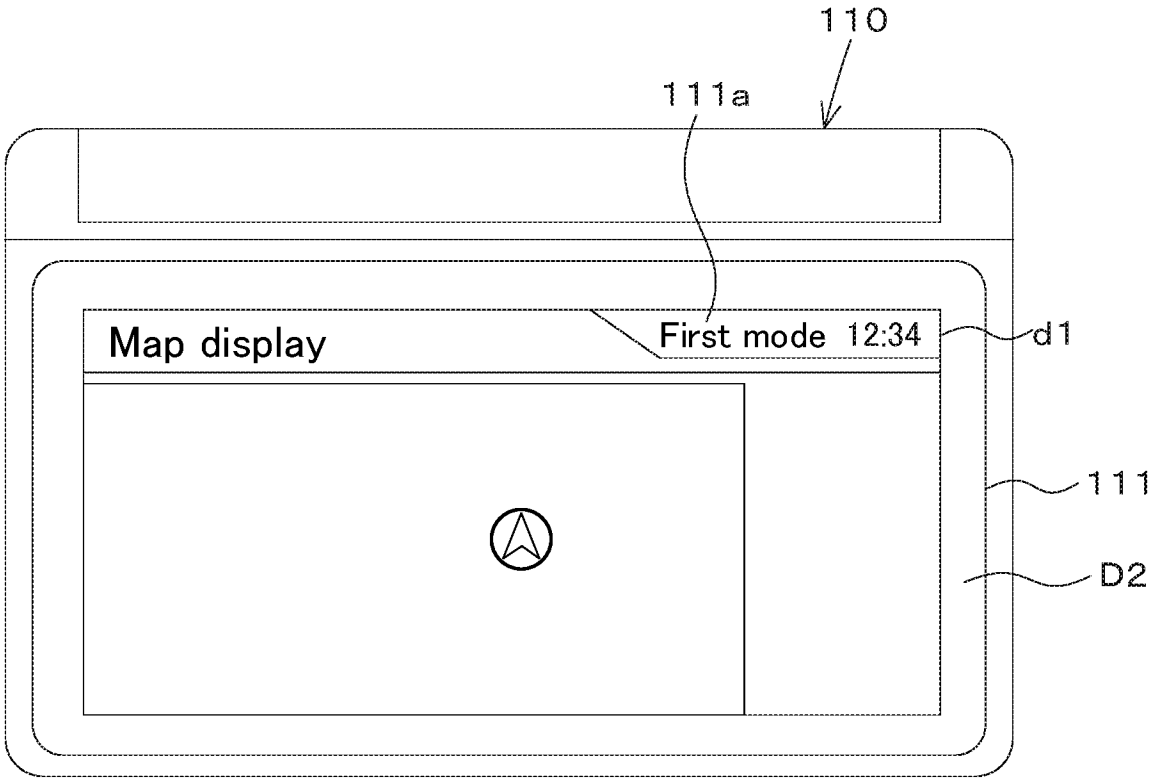
FIG. 7 is a diagram for explaining a mode display portion displayed by the display and the display unit according to the second modification example.

The display unit 111 is capable of displaying which one of the modes the controller 100 is in now. FIG. 7 is a diagram for explaining a mode display portion 111*a* displayed by the display 110 and the display unit 111 according to the modification example. For example, as illustrated in FIG. 7, there is a mode display portion 111*a* at a top area dl of a screen D2 displayed by the display unit 111. The mode display portion 111*a* shows the current mode of the controller 100 by means of a character string. In the example illustrated in FIG. 7, the current mode of the controller 100 is shown by means of a character string. However, the mode display is not limited to character-string display. The display unit 111 may display the current mode of the controller 100 by means of graphics such as any kind of icon or the like.

In the present embodiment, the controller 100 has a first mode, a second mode, and a third mode as the plurality of modes and is configured to be switchable between them. The first mode is, for example, a mode that is designed to offer enhanced operational feeling of the working machine 1 for a case where the actual number of revolutions of the traveling motor 51 is comparatively small. That is, the first mode is a mode for reducing the number of revolutions of the engine that is in balance with the delivery flow rate of the traveling pump 50 more by boosting the consumption horsepower of the traveling pump 50 when the actual number of revolutions of the traveling motor 51 is comparatively small. The third mode is a mode for giving a higher priority to engine stall suppression than to operational feeling of the working machine 1. The second mode is an intermediate mode between the first mode and the third mode. The first function M1 for each of the plurality of modes (first, second, and third modes) will now be explained.

FIG. 4C is a diagram illustrating an example of respective first functions M1 for the plurality of modes in the modification example. As illustrated in FIG. 4C, the first functions M1 have, as partial inclination of them different from mode to mode, respective slopes different from one another at the first section m1. In FIG. 4C, a first section m1*a* of the first function M1 in the first mode is indicated by a solid line, a first section m1*b* of the first function M1 in the second mode is indicated by an alternate-long-and-single-short-dashed line, and a first section m1*c* of the first function M1 in the third mode is indicated by an alternate-long-and-double-short-dashed line. The first functions M1 have the same value of the first correction coefficient when the actual number of revolutions of the traveling motor 51 is at the second threshold Rm2.

As illustrated in FIG. 4C, the slope at the first section m1 in the first mode is the steepest of those in the three modes, and the slope at the first section m1 in the third mode is the gentlest of those in the three modes. That is, an amount of change in the first correction coefficient in the first mode relative to the actual number of revolutions of the traveling motor 51 is the largest among the three modes, and the first correction coefficient in the first mode works to correct the instruction current value in such a way as to make the primary pressure at the actuation valve 70 greater than in the other modes. An amount of change in the first correction coefficient in the third mode relative to the actual number of revolutions of the traveling motor 51 is the smallest among the three modes, and the first correction coefficient in the third mode works to correct the instruction current value in such a way as to make the primary pressure at the actuation valve 70 less than in the other modes. That is, in the present embodiment, given the same actual number of revolutions of the traveling motor 51, the first correction coefficient is greater in the order of the third mode, the second mode, and the first mode.

In an example of the first function M1 corresponding to the first mode illustrated in FIG. 4C, the first correction coefficient is 1.6 (160%) when the actual number of revolutions of the traveling motor 51 is at the first lower limit value Rm1. Therefore, in the first section m1*a*, the first correction coefficient in the first mode decreases substantially linearly from 1.6 (160%) to 1.2 (120%) as the actual number of revolutions of the traveling motor 51 increases, and increases substantially linearly from 1.2 (120%) to 1.6 (160%) as the actual number of revolutions of the traveling motor 51 decreases.

In an example of the first function M1 corresponding to the second mode illustrated in FIG. 4C, the first correction coefficient is 1.5 (150%) when the actual number of revolutions of the traveling motor 51 is at the first lower limit value Rm1. Therefore, in the first section m1*b*, the first correction coefficient in the second mode decreases substantially linearly from 1.5 (150%) to 1.2 (120%) as the actual number of revolutions of the traveling motor 51 increases, and increases substantially linearly from 1.2 (120%) to 1.5 (150%) as the actual number of revolutions of the traveling motor 51 decreases.

In an example of the first function M1 corresponding to the third mode illustrated in FIG. 4C, the first correction coefficient is 1.4 (140%) when the actual number of revolutions of the traveling motor 51 is at the first lower limit value Rm1. Therefore, in the first section m1*c*, the first correction coefficient in the third mode decreases substantially linearly from 1.4 (140%) to 1.2 (120%) as the actual number of revolutions of the traveling motor 51 increases, and increases substantially linearly from 1.2 (120%) to 1.4 (140%) as the actual number of revolutions of the traveling motor 51 decreases.

Though some values of the first correction coefficient have been described in the above explanation of the plurality of modes, they are mere illustrative values mentioned just for the purpose of giving an example. It is sufficient as long as, at least, the first correction coefficient is greater in the order of the third mode, the second mode, and the first mode. The first correction coefficient in the plurality of modes may be configured to be changeable by operating an operation switch connected to the controller 100, operating a terminal, or the like.

FIG. 4D is a diagram illustrating an example of respective second functions M2 for the plurality of modes in the modification example. As illustrated in FIG. 4D, the second functions M2 have, as partial inclination of them different from mode to mode, respective slopes different from one another at the third section m3. In FIG. 4D, a third section m3*a* of the second function M2 in the first mode is indicated by a solid line, a third section m3*b* of the second function M2 in the second mode is indicated by an alternate-long-and-single-short-dashed line, and a third section m3*c* of the second function M2 in the third mode is indicated by an alternate-long-and-double-short-dashed line. The second functions M2 have the same value of the second correction coefficient when the actual number of revolutions of the prime mover 6 is at the third threshold Re2.

As illustrated in FIG. 4D, the slope at the third section m3 in the first mode is the gentlest of those in the three modes, and the slope at the third section m3 in the third mode is the steepest of those in the three modes. That is, an amount of change in the second correction coefficient in the first mode relative to the actual number of revolutions of the prime mover 6 is the smallest among the three modes, and the second correction coefficient in the first mode works to correct the instruction current value in such a way as to make the primary pressure at the actuation valve 70 greater than in the other modes. An amount of change in the second correction coefficient in the third mode relative to the actual number of revolutions of the prime mover 6 is the largest among the three modes, and the second correction coefficient in the third mode works to correct the instruction current value in such a way as to make the primary pressure at the actuation valve 70 less than in the other modes. That is, in the present embodiment, given the same actual number of revolutions of the prime mover 6, the second correction coefficient is less in the order of the first mode, the second mode, and the third mode.

In an example of the second function M2 corresponding to the first mode illustrated in FIG. 4D, the second correction coefficient is 0.9 (90%) when the actual number of revolutions of the prime mover 6 is at the second lower limit value Re1. Therefore, in the third section m3*a*, the second correction coefficient in the first mode increases substantially linearly from 0.9 (90%) to 1.0 (100%) as the actual number of revolutions of the prime mover 6 increases, and decreases substantially linearly from 1.0 (100%) to 0.9 (90%) as the actual number of revolutions of the prime mover 6 decreases.

In an example of the second function M2 corresponding to the second mode illustrated in FIG. 4D, the second correction coefficient is 0.8 (80%) when the actual number of revolutions of the prime mover 6 is at the second lower limit value Re1. Therefore, in the third section m3*b*, the second correction coefficient in the second mode increases substantially linearly from 0.8 (80%) to 1.0 (100%) as the actual number of revolutions of the prime mover 6 increases, and decreases substantially linearly from 1.0 (100%) to 0.8 (80%) as the actual number of revolutions of the prime mover 6 decreases.

In an example of the second function M2 corresponding to the third mode illustrated in FIG. 4D, the second correction coefficient is 0.5 (50%) when the actual number of revolutions of the prime mover 6 is at the second lower limit value Re1. Therefore, in the third section m3*c*, the second correction coefficient in the third mode increases substantially linearly from 0.5 (50%) to 3 (100%) as the actual number of revolutions of the prime mover 6 increases, and decreases substantially linearly from 1.0 (100%) to 0.5 (50%) as the actual number of revolutions of the prime mover 6 decreases.

Though some values of the second correction coefficient have been described in the above explanation of the plurality of modes, they are mere illustrative values mentioned just for the purpose of giving an example. It is sufficient as long as, at least, the second correction coefficient is less in the order of the first mode, the second mode, and the third mode. The second correction coefficient in the plurality of modes may be configured to be changeable by operating an operation switch connected to the controller 100, operating a terminal, or the like.

Figure 5C:
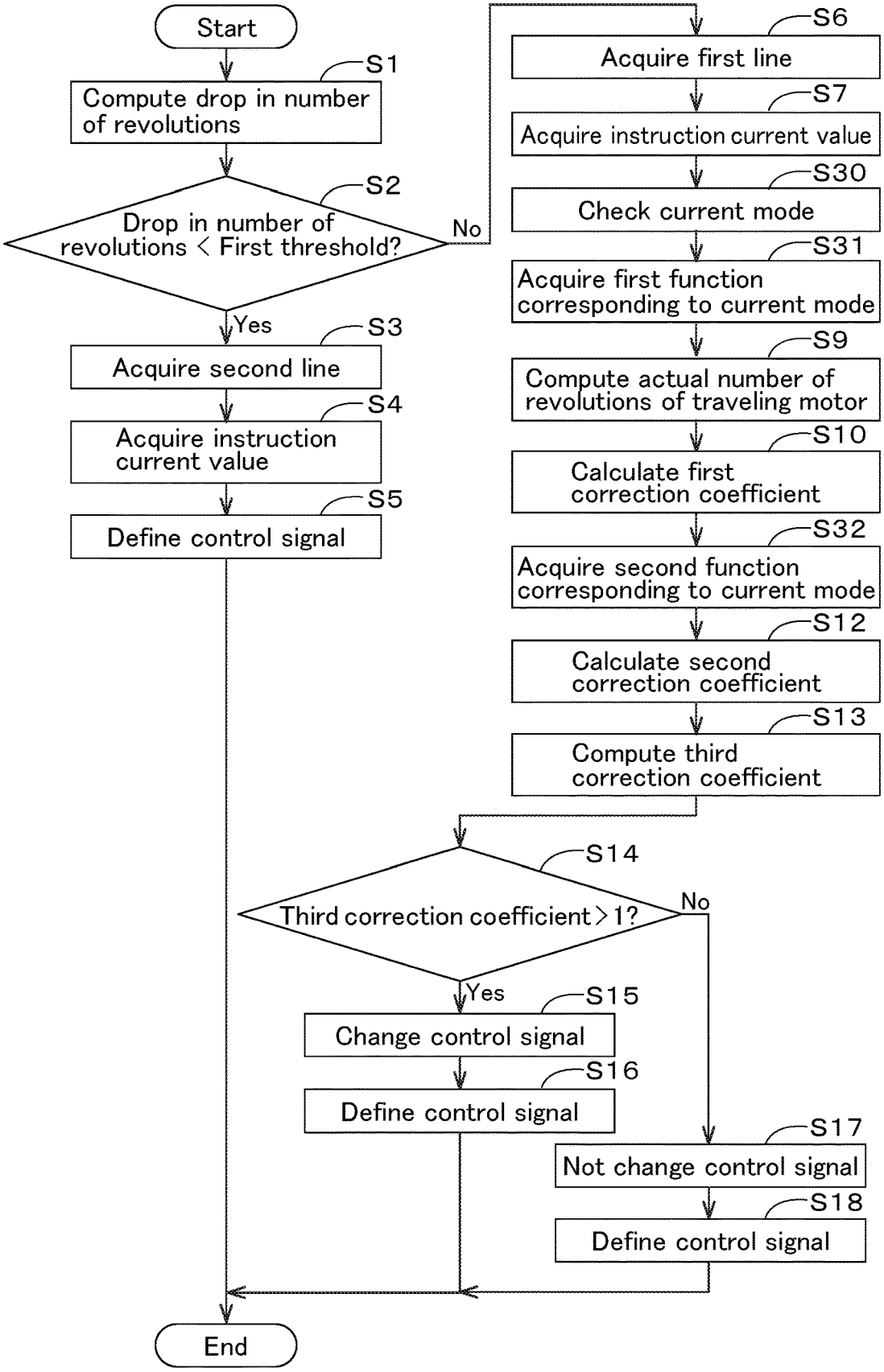
FIG. 5C is an operation flowchart illustrating the flow of operation of the controller for changing the control signal according to the second modification example.

FIG. 5C is an operation flowchart illustrating the flow of operation of the controller 100 for changing the control signal according to a second modification example. Described below with reference to FIG. 5C is a series of steps for changing the control signal (instruction current value) when the controller 100 is configured to be switchable between the plurality of modes. In this case, the flow of operation of the controller 100 for correcting the control signal is different from the operation flow illustrated in FIG. 5A in that, as illustrated in FIG. 5C, S8 is replaced with S30 and S31, and S11 is replaced with S32. The description below will be given with a focus on S30-S31 and S32, and the other steps will not be explained.

After the acquisition of the instruction current value corresponding to the actual number of revolutions by the processor 100*b* (S7), the changer 100*c* checks the current mode of the controller 100 (S30). Specifically, based on operation information of the switcher 105, the changer 100*c* checks which one of the modes the controller 100 is in now. After checking the current mode of the controller 100 (S30), the changer 100*c* acquires the first function M1 corresponding to the current mode from the storage unit 100*a* (S31).

After acquiring the first function M1 from the storage unit 100*a* (S31), based on a detection signal of the first detector 104, the changer 100*c* computes the actual number of revolutions of the traveling motor 51 (S9).

After calculating the first correction coefficient (S10), the changer 100*c* acquires the second function M2 corresponding to the current mode from the storage unit 100*a* (S32).

After acquiring the second function M2 from the storage unit 100*a* (S32), the changer 100*c* calculates the second correction coefficient by substituting the actual number of revolutions of the prime mover 6 into the second function M2 (S12).

In the foregoing embodiment, the actuation valve 70 is provided upstream of the operation valves 56 (delivery fluid passage 40). However, for example, the actuation valve 70 may be provided somewhere on the fifth traveling fluid passage 42*e* instead.

Figure 8:
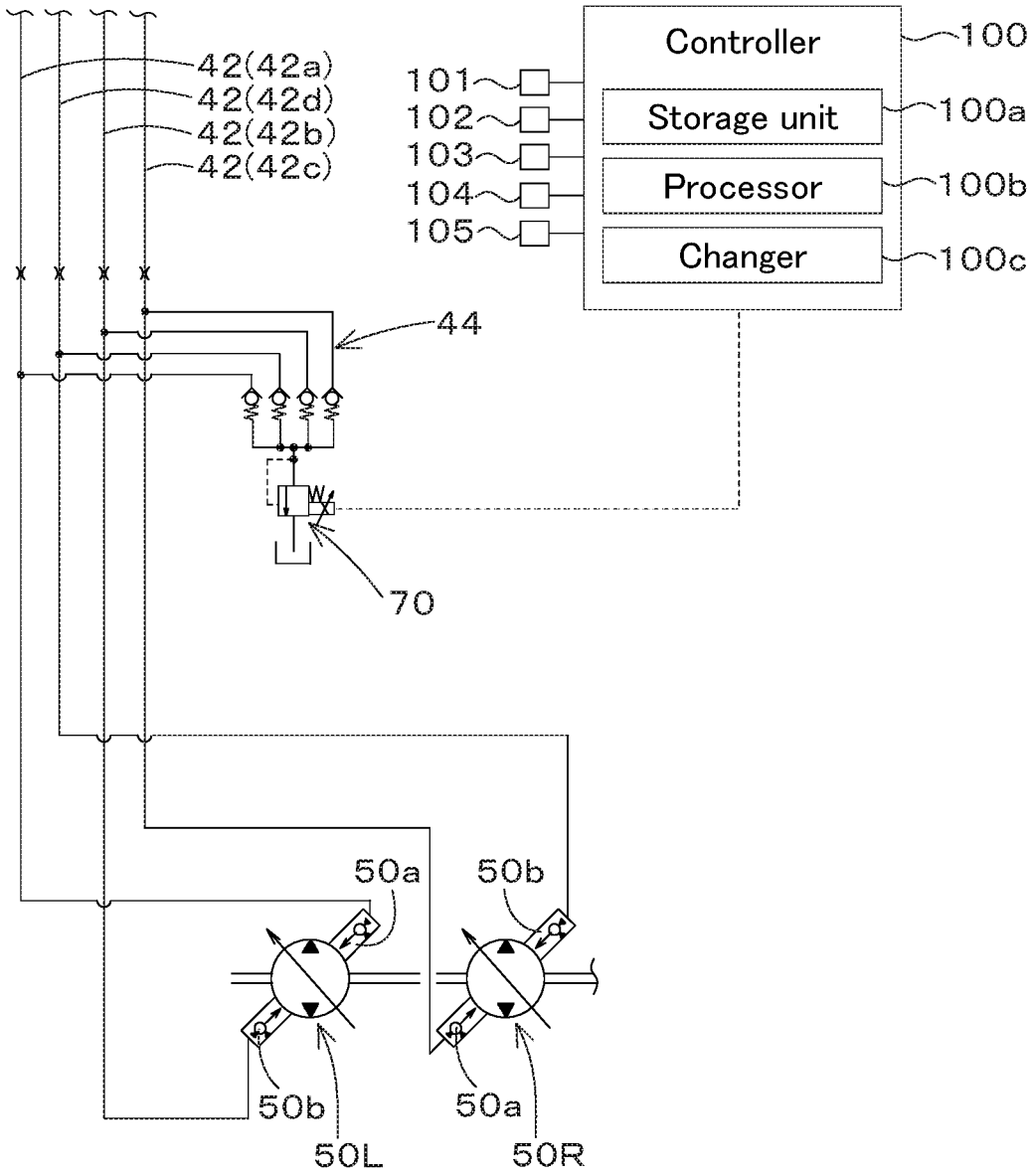
FIG. 8 is a diagram illustrating an example of a case where an actuation valve is provided on a secondary side of an operation valve according to a third modification example.

Alternatively, as illustrated in FIG. 8, the actuation valve 70 may be provided on the traveling fluid passage 42 connected to the traveling pump 50 (the first traveling pump SOL and the second traveling pump 50R). Specifically, fluid passages 44 branching off from the first traveling fluid passage 42*a*, the second traveling fluid passage 42*b*, the third traveling fluid passage 42*c*, and the fourth traveling fluid passage 42*d* respectively may be provided, and the actuation valve 70 such as a variable relief valve or a proportional solenoid valve may be provided on the fluid passages 44, and the opening of the actuation valve 70 may be controlled by means of a first control signal and a second control signal.

In the foregoing embodiment, the manipulator 54 is a hydraulic-type device configured to change pilot pressure acting on the traveling pump 50 (the first traveling pump SOL and the second traveling pump 50R) by means of the operation valves 56. However, as illustrated in FIG. 9, the manipulator 54 may be an electric-type device configured to operate electrically.

Figure 9:
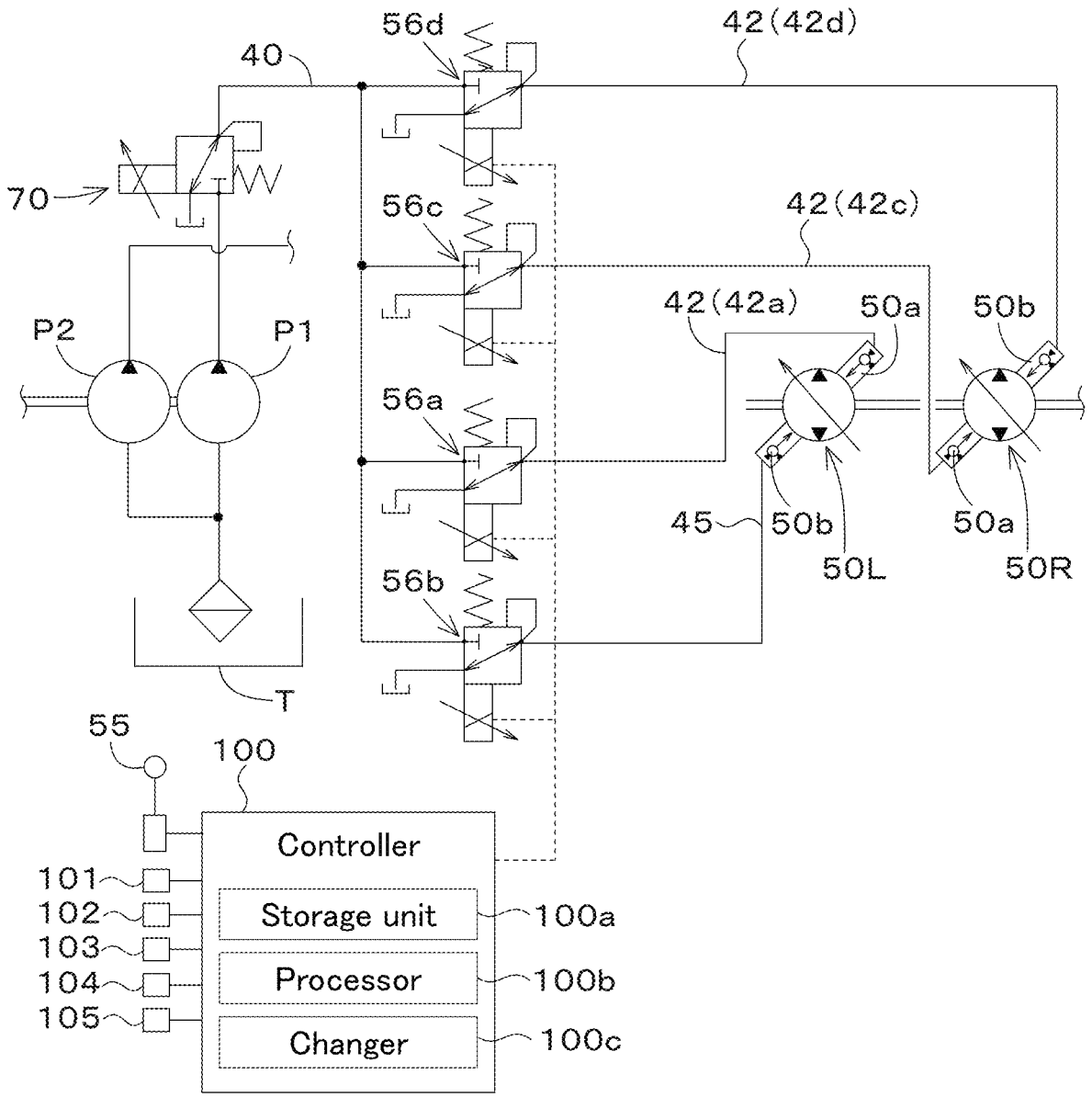
FIG. 9 is a diagram illustrating a modified configuration according to a fourth modification example in which a hydraulic-type manipulator is replaced with an electric-type manipulator such as a joystick.

As illustrated in FIG. 9, the manipulator 54 includes the operation member 55 configured to be swung in the left-right direction (machine-body width direction) or the front-rear direction selectively and the operation valves 56 (the first pilot valve 56*a*, the second pilot valve 56*b*, the third pilot valve 56*c*, and the fourth pilot valve 56*d*) that are proportional solenoid valves. An operation detection sensor configured to detect an operation amount and an operation direction of the operation member 55 is connected to the controller 100. Based on the operation amount and the operation direction detected by the operation detection sensor, the controller 100 controls the operation valves 56 (the first pilot valve 56*a*, the second pilot valve 56*b*, the third pilot valve 56*c*, and the fourth pilot valve 56*d*).

When the operation member 55 is operated forward (in the direction indicated by the arrow A1; see FIG. 1), the controller 100 outputs control signals to the first pilot valve 56*a* and the third pilot valve 56*c* to cause the swash plates of the first traveling pump SOL and the second traveling pump SOR to tilt in the normal (forward) direction.

When the operation member 55 is operated rearward (in the direction indicated by the arrow A2; see FIG. 1), the controller 100 outputs control signals to the second pilot valve 56*b* and the fourth pilot valve 56*d* to cause the swash plates of the first traveling pump SOL and the second traveling pump SOR to tilt in the reverse (rearward) direction.

When the operation member 55 is operated leftward (in the direction indicated by the arrow A3; see FIG. 1), the controller 100 outputs control signals to the second pilot valve 56*b* and the third pilot valve 56*c* to cause the swash plate of the first traveling pump SOL to tilt in the reverse direction and cause the swash plate of the second traveling pump SOR to tilt in the normal direction.

When the operation member 55 is operated rightward (in the direction indicated by the arrow A4; see FIG. 1), the controller 100 outputs control signals to the first pilot valve 56*a* and the fourth pilot valve 56*d* to cause the swash plate of the first traveling pump SOL to tilt in the normal direction and cause the swash plate of the second traveling pump SOR to tilt in the reverse direction.

The working machine 1 described above includes: the prime mover 6; the traveling pump 50 configured to operate by power of the prime mover 6 and deliver a hydraulic fluid; the traveling motor 51 capable of rotating using the hydraulic fluid delivered by the traveling pump 50; the operation valve 56 capable of changing pilot pressure of a pilot fluid outputted to the traveling pump 50 in response to operation of the operation member 55; the actuation valve 70 configured to operate based on a control signal and capable of changing primary pressure that is the pilot pressure of the pilot fluid supplied to the operation valve 56; the controller 100 configured or programmed to control the opening of the actuation valve 70 by outputting the control signal to the actuation valve 70; and the first detector 104 configured to detect the actual number of revolutions of the traveling motor 51, wherein the controller 100 includes the changer 100*c* configured or programmed to change setting of the control signal such that the opening of the actuation valve 70 increases as the actual number of revolutions of the traveling motor 51 decreases. With this configuration, based on the actual number of revolutions of the traveling motor 51, the controller 100 is able to change the setting of the control signal outputted to the actuation valve 70 by means of the changer 100*c*. Therefore, based on the actual number of revolutions of the traveling motor 51, the controller 100 is able to change the primary pressure that is the pilot pressure of the pilot fluid supplied by the actuation valve 70 to the operation valve 56. By this means, it is possible to give an operational feeling that the working machine 1 is performing work with sufficient performance to the operator according to the actual number of revolutions of the traveling motor 51.

The working machine 1 further includes: the number-of-revolutions operation actuator 102 configured for the operator to operate a target number of revolutions of the prime mover 6; the second detector 103 configured to detect an actual number of revolutions of the prime mover 6; and the storage unit 100*a* in which the first line La and the second line Lb are stored, the first line La being a line defining the control signal based on the actual number of revolutions of the prime mover 6 in a case where a difference between the target number of revolutions of the prime mover 6 and the actual number of revolutions of the prime mover 6 is not less than a first threshold, the second line Lb being a line defining the control signal to be greater than defined by the first line La in a case where the difference is less than the first threshold, wherein the changer 100*c* changes the first line La by changing the control signal expressed by the first line La such that the opening of the actuation valve 70 increases as the actual number of revolutions of the traveling motor 51 decreases. With this configuration, depending on which of two cases applies, one of the two cases being a case where the prime mover 6 is under light load (the difference between the target number and the actual number is less than the first threshold), and the other being a case where the prime mover 6 is under heavy load (the difference between the target number and the actual number is not less than the first threshold), the changer 100*c* is able to change the setting of the control signal outputted to the actuation valve 70 appropriately based on the actual number of revolutions of the traveling motor 51.

Based on a first correction coefficient defined in relation to the actual number of revolutions of the traveling motor 51, the changer 100*c* changes the control signal expressed by the first line La. With this configuration, the changer 100*c* is able to change the setting of the control signal outputted to the actuation valve 70 by using the first correction coefficient defined in relation to the actual number of revolutions of the traveling motor 51. Therefore, it is possible to change the control signal easily and appropriately.

The first function M1 specifying a relation between the actual number of revolutions of the traveling motor 51 and the first correction coefficient is stored in the storage unit 100*a*, and the changer 100*c* calculates the first correction coefficient by substituting the actual number of revolutions of the traveling motor 51 detected by the first detector 104 into the first function M1. With this configuration, the changer 100*c* is able to calculate the correction coefficient easily and accurately by using the function specifying the relation between the actual number of revolutions of the traveling motor 51 and the first correction coefficient.

The first function M1 defines the first correction coefficient in terms of value that is not less than one, wherein a definition is given such that the first correction coefficient corresponding to a second number of revolutions, which represents the actual number of revolutions of the traveling motor 51 and is less than a first number of revolutions, is greater than the first correction coefficient corresponding to the first number of revolutions, which represents the actual number of revolutions of the traveling motor 51. With this configuration, since the first correction coefficient is defined in terms of value that is not less than one, the changer 100*c* is able to increase the consumption horsepower of the traveling pump 50 by changing the first line La in a direction in which the primary pressure outputted from the actuation valve 70 increases. More particularly, the changer 100*c* is able to increase the consumption horsepower of the traveling pump 50 to reduce the number of revolutions of the engine that is in balance with the delivery flow rate of the traveling pump 50 when the actual number of revolutions of the traveling motor 51 is comparatively small. By this means, the controller 100 is able to prevent a decrease in traveling power in a high-revolution range while preventing a phenomenon in which the prime mover 6 remains at high revolution, and give an operational feeling that the working machine 1 is performing work with sufficient performance to the operator. Moreover, even when there is an increase in traveling load, it is possible to continue the work by increasing the delivery flow rate of the traveling pump 50.

The first function M1 has different degrees of inclination with respect to a second threshold Rm2 of the actual number of revolutions of the traveling motor 51. The degree of inclination of the first function M1 in a range where the actual number of revolutions of the traveling motor 51 is not greater than the second threshold Rm2 is greater than the degree of inclination of the first function M1 in a range where the actual number of revolutions of the traveling motor 51 is not less than the second threshold Rm2 With this configuration, the changer 100*c* is able to increase the consumption horsepower of the traveling pump 50 by increasing the output of the traveling pump 50 when the actual number of revolutions of the traveling motor 51 is comparatively small as in a case where of performing work such as pushing dirt. Therefore, it is possible to reduce the number of revolutions of the engine that is in balance therewith, and give an operational feeling that the working machine 1 is performing work with sufficient performance to the operator.

The controller 100 is switchable between a plurality of modes, and a plurality of first functions M1 different from one another in terms of inclination at least partially, to correspond to the plurality of modes, is stored in the storage unit 100*a*, and the changer 100*c* calculates the first correction coefficient based on, among the plurality of first functions M1, a first function M1 that corresponds to a mode of the controller 100. With this configuration, the controller is able to change the mode depending on the degree of priority, for example, "engine stall suppression first", "operational feeling first", "traveling power first", and the like.

Based on a second correction coefficient defined in relation to the actual number of revolutions of the prime mover 6 in addition to the first correction coefficient, the changer 100*c* changes the control signal expressed by the first line La. With this configuration, the changer 100*c* is able to change the setting of the control signal outputted to the actuation valve 70 by using the second correction coefficient defined in relation to the actual number of revolutions of the prime mover 6. Therefore, it is possible to change the control signal easily and appropriately.

The second function M2 specifying a relation between the actual number of revolutions of the prime mover 6 and the second correction coefficient is stored in the storage unit 100*a*, and the changer 100*c* calculates the second correction coefficient by substituting the actual number of revolutions of the prime mover 6 detected by the second detector 103 into the second function M2. With this configuration, the changer 100*c* is able to calculate the correction coefficient easily and accurately by using the function specifying the relation between the actual number of revolutions of the prime mover 6 and the second correction coefficient.

The second function M2 defines the second correction coefficient as a value equal to one when the actual number of revolutions of the prime mover 6 is not less than the third threshold Re2, and defines the second correction coefficient in terms of value that is less than one when the actual number of revolutions of the prime mover 6 is less than the third threshold Re2. With this configuration, when the number of revolutions of the prime mover 6 is less than the third threshold Re2 and is comparatively small, the changer 100*c* is able to change the first line La in a direction in which the primary pressure outputted from the actuation valve 70 decreases. By this means, it is possible to reduce the output of the traveling pump 50 and thus prevent the engine from stalling.

The controller 100 is switchable between a plurality of modes, and a plurality of second functions M2 different from one another in terms of inclination at least partially, to correspond to the plurality of modes, is stored in the storage unit 100*a*, and the changer 100*c* calculates the second correction coefficient based on, among the plurality of second functions M2, a second function M2 that corresponds to a mode of the controller 100. With this configuration, the controller is able to change the mode depending on the degree of priority, for example, "engine stall suppression first", "operational feeling first", "traveling power first", and the like.

The changer 100*c* computes a third correction coefficient based on a product of the first correction coefficient and the second correction coefficient. The changer 100*c* changes the control signal expressed by the first line La in a case where the value of the third correction coefficient is greater than one and does not change the control signal expressed by the first line La in a case where the value of the third correction coefficient is not greater than one. With this configuration, it is possible to prevent the changer 100*c* from changing the first line La excessively in a direction in which the primary pressure outputted from the actuation valve 70 decreases. That is, it is possible to prevent the traveling power of the traveling motor 51 from being reduced excessively due to changing the first line La by the changer 100*c* when the actual number of revolutions of the prime mover 6 is less than the third threshold Re2.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine, comprising:

a prime mover;

a traveling pump to be operated by power of the prime mover and deliver a hydraulic fluid;

a traveling motor, configured to transmit power to a drive shaft of a traveling device, to rotate using the hydraulic fluid delivered by the traveling pump;

an operation valve to change pilot pressure of a pilot fluid outputted to the traveling pump in response to operation of an operation member;

an actuation valve, provided upstream from the operation valve on a fluid passage, to operate based on a control signal and change primary pressure that is the pilot pressure of the pilot fluid supplied to the operation valve from the fluid passage;

a controller configured or programmed to control opening of the actuation valve by outputting the control signal to the actuation valve; and a first detector to detect an actual number of revolutions of the traveling motor, wherein the controller includes a changer configured or programmed to change setting of the control signal such that the opening of the actuation valve increases as the actual number of revolutions of the traveling motor decreases.

2. The working machine according to claim 1, further comprising:

a number-of-revolutions operation actuator configured for an operator to operate a target number of revolutions of the prime mover;

a second detector to detect an actual number of revolutions of the prime mover; and a storage unit in which a first line and a second line are stored, the first line defining the control signal based on the actual number of revolutions of the prime mover in a case where a difference between the target number of revolutions of the prime mover and the actual number of revolutions of the prime mover is not less than a first threshold, the second line defining the control signal to be greater than defined by the first line in a case where the difference is less than the first threshold, wherein the changer is configured or programmed to change the first line by changing the control signal expressed by the first line such that the opening of the actuation valve increases as the actual number of revolutions of the traveling motor decreases.

3. The working machine according to claim 2, wherein, based on a first correction coefficient defined in relation to the actual number of revolutions of the traveling motor, the changer is configured or programmed to change the control signal expressed by the first line.

4. The working machine according to claim 3, wherein, at least one first function specifying a relation between the actual number of revolutions of the traveling motor and the first correction coefficient is stored in the storage unit, and the changer is configured or programmed to calculate the first correction coefficient by substituting the actual number of revolutions of the traveling motor detected by the first detector into the at least one first function.

5. The working machine according to claim 4, wherein, the at least one first function defines the first correction coefficient in terms of value that is not less than one, such that the first correction coefficient corresponding to a second number of revolutions, which represents the actual number of revolutions of the traveling motor and is less than a first number of revolutions, is greater than the first correction coefficient corresponding to the first number of revolutions, which represents the actual number of revolutions of the traveling motor.

6. The working machine according to claim 5, wherein, the at least one first function has degrees of inclination which are different depending on whether the actual number of revolutions of the traveling motor is less than a second threshold thereof, and the degree of inclination of the at least one first function in a range where the actual number of revolutions of the traveling motor is equal to or less than the second threshold, is greater than the degree of inclination of the at least one first function in a range where the actual number of revolutions of the traveling motor is not less than the second threshold.

7. The working machine according to claim 4, wherein, the controller is operable to be switched among a plurality of modes, and as the at least one first function, a plurality of first functions different from one another in terms of inclination at least partially, to correspond to the plurality of modes, is stored in the storage unit, and the changer is configured or programmed to calculate the first correction coefficient based on, among the plurality of first functions, a first function that corresponds to a mode of the controller.

8. The working machine according to claim 3, wherein, based on a second correction coefficient defined in relation to the actual number of revolutions of the prime mover in addition to the first correction coefficient, the changer is configured or programmed to change the control signal expressed by the first line.

9. The working machine according to claim 8, wherein, at least one second function specifying a relation between the actual number of revolutions of the prime mover and the second correction coefficient is stored in the storage unit, and the changer is configured or programmed to calculate the second correction coefficient by substituting the actual number of revolutions of the prime mover detected by the second detector into the at least one second function.

10. The working machine according to claim 9, wherein, the at least one second function defines the second correction coefficient as a value equal to one when the actual number of revolutions of the prime mover is not less than a third threshold, and defines the second correction coefficient in terms of value that is less than one when the actual number of revolutions of the prime mover is less than the third threshold.

11. The working machine according to claim 9, wherein, the controller is operable to be switched among a plurality of modes, and as the at least one second function, a plurality of second functions different from one another in terms of inclination at least partially, to correspond to the plurality of modes, is stored in the storage unit, and the changer is configured or programmed to calculate the second correction coefficient based on, among the plurality of second functions, a second function that corresponds to a mode of the controller.

12. The working machine according to claim 8, wherein, the changer is configured or programmed to compute a third correction coefficient based on a product of the first correction coefficient and the second correction coefficient, change the control signal expressed by the first line in a case where a value of the third correction coefficient is greater than one, and not change the control signal expressed by the first line in a case where the value of the third correction coefficient is not greater than one.

13. The working machine according to claim 5, wherein, the controller is operable to be switched among a plurality of modes, and as the at least one first function, a plurality of first functions different from one another in terms of inclination at least partially, to correspond to the plurality of modes, is stored in the storage unit, and the changer is configured or programmed to calculate the first correction coefficient based on, among the plurality of first functions, a first function that corresponds to a mode of the controller.

14. The working machine according to claim 6, wherein, the controller is operable to be switched among a plurality of modes, and as the at least one first function, a plurality of first functions different from one another in terms of inclination at least partially, to correspond to the plurality of modes, is stored in the storage unit, and the changer is configured or programmed to calculate the first correction coefficient based on, among the plurality of first functions, a first function that corresponds to a mode of the controller.

15. The working machine according to claim 4, wherein, based on a second correction coefficient defined in relation to the actual number of revolutions of the prime mover in addition to the first correction coefficient, the changer is configured or programmed to change the control signal expressed by the first line.

16. The working machine according to claim 5, wherein, based on a second correction coefficient defined in relation to the actual number of revolutions of the prime mover in addition to the first correction coefficient, the changer is configured or programmed to change the control signal expressed by the first line.

17. The working machine according to claim 6, wherein, based on a second correction coefficient defined in relation to the actual number of revolutions of the prime mover in addition to the first correction coefficient, the changer is configured or programmed to change the control signal expressed by the first line.

18. The working machine according to claim 7, wherein, based on a second correction coefficient defined in relation to the actual number of revolutions of the prime mover in addition to the first correction coefficient, the changer is configured or programmed to change the control signal expressed by the first line.

19. The working machine according to claim 10, wherein, the controller is operable to be switched among a plurality of modes, and as the at least one second function, a plurality of second functions different from one another in terms of inclination at least partially, to correspond to the plurality of modes, is stored in the storage unit, and the changer is configured or programmed to calculate the second correction coefficient based on, among the plurality of second functions, a second function that corresponds to a mode of the controller.

20. The working machine according to claim 9, wherein, the changer is configured or programmed to compute a third correction coefficient based on a product of the first correction coefficient and the second correction coefficient, change the control signal expressed by the first line in a case where a value of the third correction coefficient is greater than one, and not change the control signal expressed by the first line in a case where the value of the third correction coefficient is not greater than one.

* * * * *